US008944136B2

(12) United States Patent
Smart

(10) Patent No.: US 8,944,136 B2
(45) Date of Patent: Feb. 3, 2015

(54) FOLDING PARTITIONS HAVING ADJOINING PANELS AND RELATED METHODS

(71) Applicant: Won-Door Corporation, Salt Lake City, UT (US)

(72) Inventor: R. Scott Smart, Sandy, UT (US)

(73) Assignee: Won-Door Corporation, Salt Lake City, UT (US)

( * ) Notice: Subject to any disclaimer, the term of this patent is extended or adjusted under 35 U.S.C. 154(b) by 0 days.

(21) Appl. No.: 13/751,984

(22) Filed: Jan. 28, 2013

(65) Prior Publication Data

US 2013/0139456 A1 Jun. 6, 2013

Related U.S. Application Data

(63) Continuation of application No. 12/712,922, filed on Feb. 25, 2010, now Pat. No. 8,376,020.

(51) Int. Cl.

| | |
|---|---|
| ***E05D 15/26*** | (2006.01) |
| ***E04B 2/88*** | (2006.01) |
| *E05D 1/04* | (2006.01) |
| *E05F 15/00* | (2006.01) |

(52) U.S. Cl.

CPC ..... *E04B 2/88* (2013.01); *E05D 15/266* (2013.01); *E05D 1/04* (2013.01); *E05F 15/00* (2013.01)

USPC ..... 160/199; 160/235

(58) Field of Classification Search

USPC ..... 160/199, 206, 84.09, 84.11, 183, 235, 160/84.08

See application file for complete search history.

(56) References Cited

U.S. PATENT DOCUMENTS 1,014,611 A * 1/1912 Rush ..... 160/235
1,017,808 A * 2/1912 Rush ..... 160/235

(Continued)

FOREIGN PATENT DOCUMENTS

DE 20 2005 000 165 U1 3/2006
JP 2003082796 3/2003
WO 2005/098189 A1 10/2005

OTHER PUBLICATIONS

International Search Report and Written Opinion for PCT Application No. PCT/US2011/022773, filed Jan. 27, 2011, mailed Sep. 28, 2011, 9 pages.

(Continued)

*Primary Examiner* — David Purol
(74) *Attorney, Agent, or Firm* — TraskBritt

(57) ABSTRACT

Movable partitions and partition systems include a sheet of interconnected panels configured to fold in an accordion fashion. At least two of the interconnected panels have first and second lateral ends extending between a top edge and a bottom edge of the panels. The lateral ends may comprise generally cylindrical structures having openings comprising gaps between lateral edges of the respective panel and a first major surface of the respective panel. The first lateral end of one panel may be engaged with the second lateral end of another panel of the at least two panels. The lateral edges may be enlarged. The at least two panels can extend to a fully extended state in which they are coplanar. Methods of forming movable partitions and partition systems include forming and interconnecting such panels. Methods of repairing movable partitions and partition systems include disengaging such panels by applying lateral forces therebetween.

13 Claims, 18 Drawing Sheets

(56) References Cited

U.S. PATENT DOCUMENTS

| | | | | | |
|---|---|---|---|---|---|
| 2,586,561 | A | | 2/1952 | Giovanni | |
| 3,481,388 | A | | 12/1969 | Smart | |
| 3,485,284 | A | | 12/1969 | Turner et al. | |
| 3,485,287 | A | * | 12/1969 | Milbourne, Sr. | 160/235 |
| 3,577,679 | A | | 5/1971 | Petterborg | |
| 3,720,254 | A | | 3/1973 | Smart | |
| 3,782,444 | A | | 1/1974 | Rapp et al. | |
| 3,799,237 | A | | 3/1974 | Proserpi | |
| 3,907,020 | A | | 9/1975 | Root | |
| 3,972,365 | A | | 8/1976 | Dixon | |
| 4,133,364 | A | | 1/1979 | Smart | |
| 4,224,767 | A | | 9/1980 | Jecmen et al. | |
| 4,386,645 | A | * | 6/1983 | Dever et al. | 160/183 |
| 4,467,562 | A | | 8/1984 | Hemmerling | |
| 4,532,973 | A | | 8/1985 | DeFalco | |
| 4,644,724 | A | | 2/1987 | Schijf | |
| 4,660,613 | A | * | 4/1987 | Dagenais | 160/199 |
| 4,823,531 | A | * | 4/1989 | Labelle | 52/586.2 |
| 4,924,932 | A | | 5/1990 | Esnault | |
| 4,957,600 | A | | 9/1990 | Carlson et al. | |
| 5,220,951 | A | * | 6/1993 | Dagenais | 160/199 |
| 5,458,179 | A | | 10/1995 | Magaldi et al. | |
| 5,542,460 | A | | 8/1996 | McKeon | |
| 5,566,739 | A | | 10/1996 | Hoffman | |
| 5,625,266 | A | | 4/1997 | Stark | |
| 6,209,171 | B1 | | 4/2001 | Pelletier et al. | |
| 6,220,332 | B1 | * | 4/2001 | Lai | 160/199 |
| 6,223,804 | B1 | | 5/2001 | Toti | |
| 6,325,135 | B1 | * | 12/2001 | Lee | 160/199 |
| 6,601,637 | B2 | | 8/2003 | Toti | |
| 6,615,894 | B1 | | 9/2003 | McKeon | |
| 6,662,848 | B2 | | 12/2003 | Goodman et al. | |
| 7,478,663 | B2 | | 1/2009 | Goodman et al. | |
| 7,513,293 | B2 | | 4/2009 | Goodman et al. | |
| 8,376,020 | B2 | * | 2/2013 | Smart | 160/199 |
| 2007/0294945 | A1 | | 12/2007 | Coleman et al. | |

OTHER PUBLICATIONS

International Preliminary Report on Patentability for International Application No. PCT/US2011/022773, filed Jan. 27, 2011, mailed Aug. 28, 2012, 5 pages.

* cited by examiner

FOLDING PARTITIONS HAVING ADJOINING PANELS AND RELATED METHODS

CROSS-REFERENCE TO RELATED APPLICATION

This application is a continuation of U.S. patent application Ser. No. 12/712,922, filed Feb. 25, 2010, now U.S. Pat. No. 8,376,020, issued Feb. 19, 2013, the disclosure of which is hereby incorporated herein by this reference in its entirety.

TECHNICAL FIELD

Embodiments of the invention are directed to the field of partitions used for partitioning space, as sound barriers, as fire barriers, security barriers, and for various other applications.

BACKGROUND

Movable partitions are used in numerous situations and environments for a variety of purposes. Such partitions may include, for example, foldable or collapsible doors configured to enclose or subdivide a room or other area. Such partitions may be used to temporarily divide a single large room into two or more smaller rooms. In other applications, such partitions may be used for noise control depending, for example, on the activities taking place in a given room or portion thereof.

Movable partitions may also be used to provide a security barrier, a fire barrier, or both a security barrier and a fire barrier. In such a case, the partition barrier may be configured to automatically close upon the occurrence of a predetermined event, such as the actuation of an associated alarm. For example, one or more accordion or similar folding-type partitions may be used as a security barrier, a fire barrier, or both a security barrier and a fire barrier wherein each partition is formed with a plurality of panels connected to one another with hinges. The hinged connection of the panels allows the partition to fold and collapse into a compact unit for purposes of storage when not deployed. The partition may be stored in a pocket formed in the wall of a building when in a retracted or folded state. When the partition is deployed to subdivide a single large room into multiple smaller rooms, secure an area during a fire, or for any other reason, the partition may be extended along an overhead track, which may be located above the movable partition in a header assembly, until the partition extends a desired distance across the room.

When deployed, a leading end of the movable partition, often defined by a component known as a lead post, complementarily engages another structure, such as a wall, a post, or a lead post of another door.

Automatic extension and retraction of the movable partition may be accomplished through the use of a motor located in a pocket formed in the wall of a building in which the movable partition is stored when in a retracted or folded state. The motor, which remains fixed in place within the pocket, may be used to drive extension and retraction of the movable partition. A motor for automatically extending and retracting a movable partition may also be mounted within the movable partition itself, such that the motor travels with the movable partition as the movable partition is extended and retracted using the motor.

BRIEF SUMMARY

In some embodiments, the present invention includes movable partitions that include a sheet of interconnected panels configured to extend to an extended state and to fold in an accordion fashion to a retracted state. At least two panels of the sheet of interconnected panels are directly coupled to one another. Each panel of the at least two panels has a top edge, a bottom edge, a first major surface, an opposite, second major surface, a first lateral end extending between the top edge and the bottom edge, and an opposite, second lateral end extending between the top edge and the bottom edge. The first lateral end comprises a first generally cylindrical structure having a first opening extending linearly between the top edge and the bottom edge. The first opening comprises a gap between an enlarged first lateral edge of the respective panel and the first major surface of the respective panel. The second lateral end comprises a second generally cylindrical structure having a second opening extending linearly between the top edge and the bottom edge. The second opening comprises a gap between an enlarged second lateral edge of the respective panel and the first major surface of the respective panel. The first lateral end of one panel of the at least two panels is engaged with the second lateral end of another panel of the at least two panels.

In additional embodiments, the present invention includes additional movable partitions that include a sheet of interconnected panels configured to extend toward an extended state and to fold in an accordion fashion toward a retracted state. At least two panels of the sheet of interconnected panels are directly coupled to one another. Each panel of the at least two panels has a top edge, a bottom edge, a first major surface, an opposite, second major surface, a first lateral end extending between the top edge and the bottom edge, and an opposite, second lateral end extending between the top edge and the bottom edge. The first lateral end comprises a first generally cylindrical structure having a first opening extending linearly between the top edge and the bottom edge. The first opening comprises a gap between a first lateral edge of the respective panel and the first major surface of the respective panel. The second lateral end comprises a second generally cylindrical structure having a second opening extending linearly between the top edge and the bottom edge. The second opening comprises a gap between a second lateral edge of the respective panel and the first major surface of the respective panel. The first lateral end of one panel of the at least two panels is engaged with the second lateral end of another panel of the at least two panels, and the at least two panels are capable of extending to a fully extended state in which the at least two panels are at least substantially coplanar while the first lateral end of the one panel remains engaged with the second lateral end of the another panel.

In additional embodiments, the present invention includes movable partition systems that include such interconnected panels. For example, a movable partition system may include a movable partition comprising a first sheet of interconnected panels and a second sheet of interconnected panels. The first sheet and the second sheet may be positioned side-by-side one another. Each of the first sheet of interconnected panels and the second sheet of interconnected panels may comprise at least two panels directly coupled to one another. Each panel of the at least two panels may include a top edge, a bottom edge, a first major surface, an opposite, second major surface, a first lateral end extending between the top edge and the bottom edge, and an opposite, second lateral end extending between the top edge and the bottom edge. The first lateral end may comprise a first generally cylindrical structure having a first opening extending linearly between the top edge and the bottom edge. The first opening may comprise a gap between a first lateral edge of the respective panel and the first major surface of the respective panel. The second lateral end may comprise a second generally cylindrical structure having a second opening extending linearly between the top edge and the bottom edge. The second opening may comprise a gap between a second lateral edge of the respective panel and the first major surface of the respective panel. The first lateral end of one panel of the at least two panels is engaged with the second lateral end of another panel of the at least two panels.

In yet further embodiments, the present invention includes methods of forming movable partitions and partition systems. For example, a movable partition may be formed by interconnecting a plurality of panels to form a sheet of interconnected panels configured to extend toward an extended state and to fold in an accordion fashion toward a retracted state. At least two panels of the plurality of panels may be formed to comprise a top edge, a bottom edge, a first major surface, an opposite, second major surface, a first lateral end extending between the top edge and the bottom edge, and an opposite, second lateral end extending between the top edge and the bottom edge. The first lateral end may be formed to comprise a first generally cylindrical structure having a first opening extending linearly between the top edge and the bottom edge. The first opening may be formed to comprise a gap between an enlarged first lateral edge of the respective panel and the first major surface of the respective panel. The second lateral end may be formed to comprise a second generally cylindrical structure having a second opening extending linearly between the top edge and the bottom edge. The second opening may be formed to comprise a gap between an enlarged second lateral edge of the respective panel and the first major surface of the respective panel. The first lateral end of one panel of the at least two panels may be engaged with the second lateral end of another panel of the at least two panels. The enlarged second lateral edge of the second lateral end of the another panel of the at least two panels may be configured to abut against the enlarged first lateral edge of the first lateral end of the one panel of the at least two panels as the at least two panels are extended to a fully extended state.

In additional embodiments, the present invention includes methods of repairing movable partitions that comprise at least one sheet of interconnected panels. A first panel may be removed from the sheet of interconnected panels without removing either of a second panel adjoined to the first panel and a third panel adjoined to the first panel from the sheet of interconnected panels. Each of the first panel, the second panel, and the third panel may comprise a top edge, a bottom edge, a first major surface, an opposite, second major surface, a first lateral end extending between the top edge and the bottom edge, and an opposite, second lateral end extending between the top edge and the bottom edge. The first lateral end may comprise a first generally cylindrical structure having a first opening extending linearly between the top edge and the bottom edge. The first opening may comprise a gap between a first lateral edge of the respective panel and the first major surface of the respective panel. The second lateral end may comprise a second generally cylindrical structure having a second opening extending linearly between the top edge and the bottom edge. The second opening may comprise a gap between a second lateral edge of the respective panel and the first major surface of the respective panel. Removing the first panel from the sheet of interconnected panels may comprise disengaging the first generally cylindrical structure of the first lateral end of the first panel from the generally cylindrical structure of the second lateral end of the second panel by applying lateral forces between the first lateral end of the first panel and the second lateral end of the second panel, and disengaging the second generally cylindrical structure of the second lateral end of the first panel from the generally cylindrical structure of the first lateral end of the third panel by applying lateral forces between the second lateral end of the first panel and the first lateral end of the third panel.

DETAILED DESCRIPTION

Illustrations presented herein are not meant to be actual views of any particular movable partition system, or component of a movable partition system, but are merely idealized representations which are employed to describe embodiments of the present invention. Additionally, elements common between figures may retain the same numerical designation.

Figure 1:
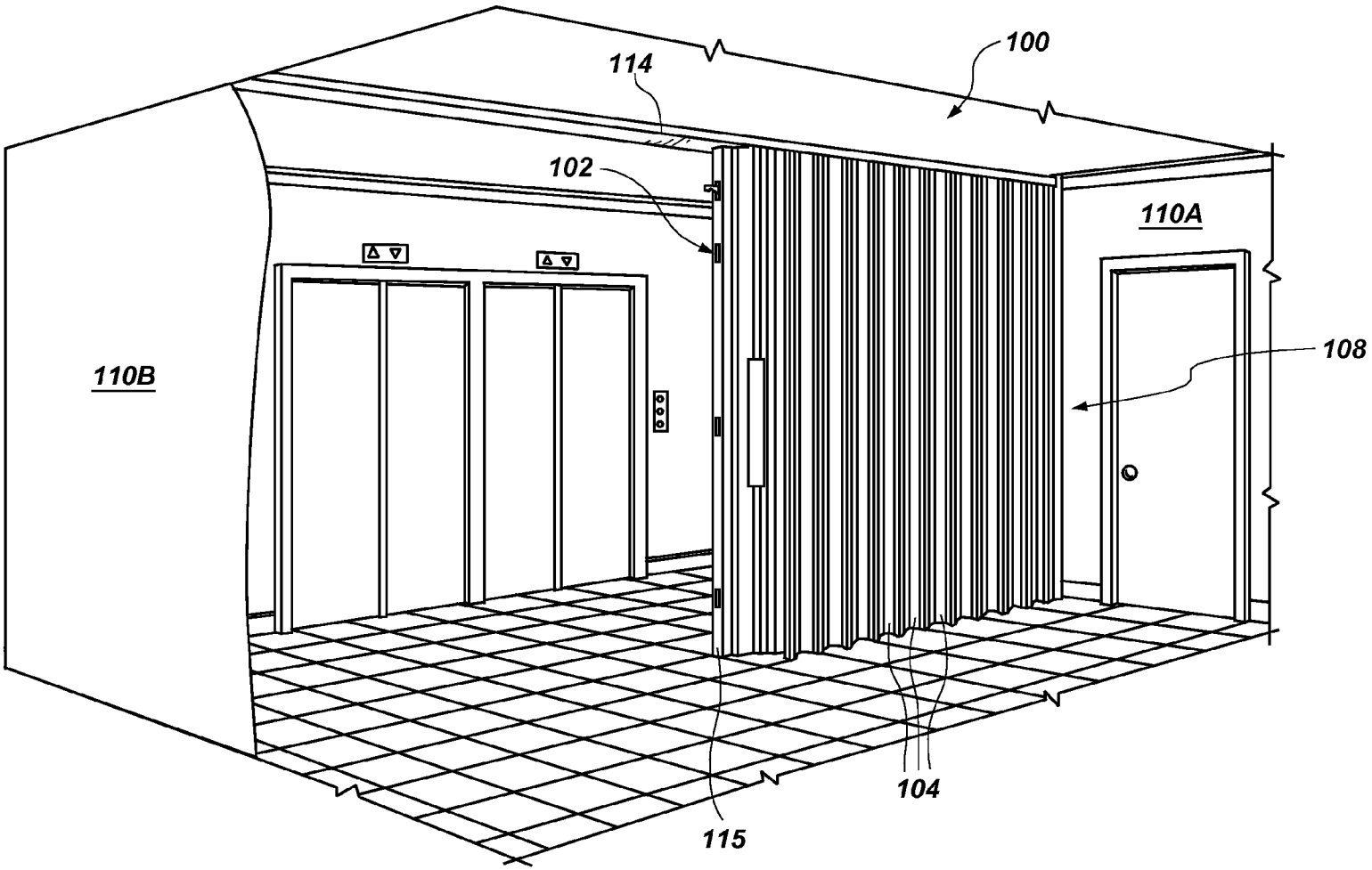
FIG. 1 is a perspective view of an embodiment of a movable partition system of the present invention.

FIG. 1 illustrates an embodiment of a movable partition system 100 of the present invention. The movable partition system 100 is an automatic movable partition system, in that the system 100 includes a movable partition 102 that may be automatically extended, automatically retracted, or both automatically extended and automatically retracted. The movable partition system 100 may comprise a motor, for example, to drive movement of the movable partition 102 between the extended and retracted states. In additional embodiments, the movable partition 102 may simply be a manually operated system, or a system that may be operated automatically or manually. The movable partition 102 may be used for partitioning space, as a sound barrier, as a fire barrier, as a security barrier, for combinations of such purposes, or for other purposes.

The movable partition 102 comprises an accordion-type door, as shown in FIG. 1. The movable partition 102 shown in FIG. 1 comprises two side-by-side sheets of panels 104, although in other embodiments, the movable partition 102 may comprises a single sheet of panels 104. A lead post 115 may be attached to a leading end of the one or more sheets of panels 104. The lead post 115 may be sized and configured to complementarily engage with a jamb or door post that may be provided in another wall 110B of a building (when the movable partition 102 is in an extended (i.e., closed) state).

In some embodiments, at least some of the panels are directly connected to one or more adjacent and adjoining panels 104 in the sheet of panels 104 without the use of any hinge member therebetween. The panels 104 in each sheet are connected to one another in such a manner as to allow the panels to fold back-and-forth relative to one another in accordion fashion to allow the movable partition 102 to collapse as the movable partition 102 is opened, which allows the movable partition 102 to be compactly stored in a pocket 108 formed in a wall 110A of a building when the movable partition 102 is in a retracted (i.e., collapsed and folded) state.

When it is desired to deploy the movable partition 102 to an extended position, the movable partition 102 is driven along a track 114 or track assembly across the space to provide an appropriate barrier. The movable partition 102 may be suspended from (i.e., hung from) a track 114 that is mounted to a ceiling or a door header. For example, a plurality of roller assemblies 116 may be mounted to the movable partition 102. Each roller assembly 116 may include one or more rollers 118 (e.g., wheels) that are configured to be positioned in and supported by a roller channel of the track 114. Thus, the roller assemblies 116 are coupled to and supported by the track 114, and the movable partition is coupled to and supported by the roller assemblies 116. The movable partition 102 may be suspended over the floor, although one or more sweep members may be provided along the lower end or ends of the movable partition system to establish a seal with the floor over which the movable partition 102 is suspended.

It is noted that, while the embodiment of the movable partition system 100 of FIG. 1 includes a single movable partition 102, the movable partition system 100 may comprise more than one movable partition 102 in further embodiments of the invention.

Figure 2:
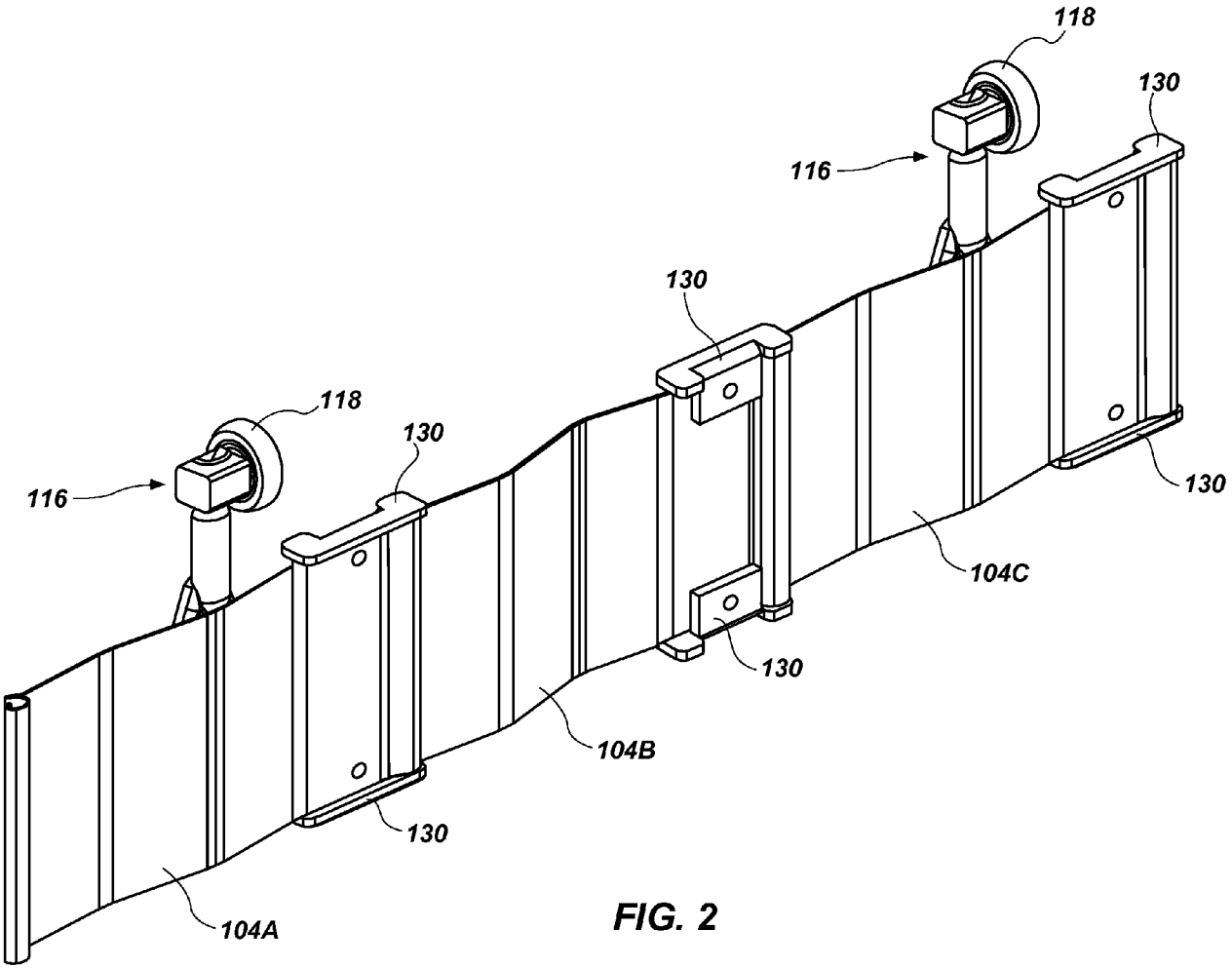
FIG. 2 is a simplified perspective view of a first side of a series of assembled panels of the movable partition system of FIG. 1 shown in a fully extended state.

FIG. 2 is a simplified illustration of a portion of a sheet of panels 104 of the movable partition 102 of FIG. 1. The portion of the sheet of panels 104 shown in FIG. 2 includes a first panel 104A, a second panel 104B, and a third panel 104C. A lateral end of the first panel 104A is directly adjoined to a first lateral end of the adjacent second panel 104B, and an opposite, second lateral end of the second panel 104B is directly adjoined to a lateral end of the third panel 104C. The height of the panels 104A, 104B, 104C in FIG. 2 (as well as in other figures herein) has been reduced to facilitate illustration and description of the various features of the panels 104 of the movable partition 102.

With continued reference to FIG. 2, one or more retention clips 130 may be used to prevent undesirable, inadvertent separation of any of the adjoining lateral ends of the panels 104A, 104B, 104C. For example, a retention clip 130 may be attached to each of the panels 104A, 104B, 104C along upper and lower ends of the panels 104A, 104B, 104C (from the perspective of FIG. 2), such that a retention clip 130 covers each of the adjoining lateral ends of the panels 104A, 104B, 104C. In this configuration, the panels 104A, 104B, 104C are prevented from sliding relative to one another in the directions parallel to the adjoining lateral ends of the panels 104A, 104B, 104C. As discussed in further detail below, the retention clips 130 also may be configured to prevent the adjoining lateral ends of the panels 104A, 104B, 104C from decoupling from one another by moving laterally relative to one another along any direction generally perpendicular to the adjoining lateral ends of the panels 104A, 104B, 104C.

Figure 3:
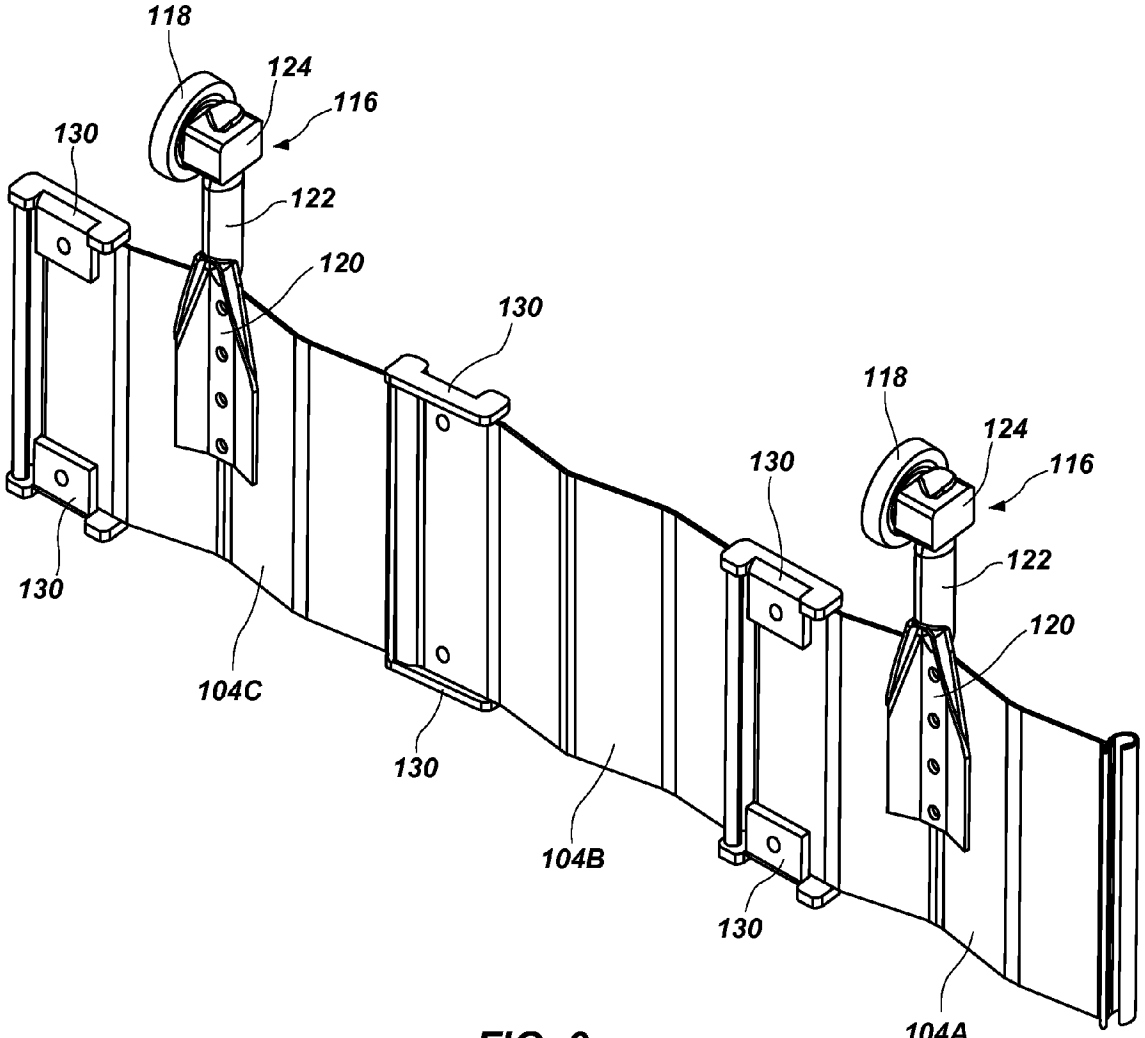
FIG. 3 is a simplified perspective view of an opposite second side of the series of assembled panels shown in FIG. 2.

FIG. 3 is another simplified illustration of the portion of the sheet of panels 104 shown in FIG. 2. As shown in FIG. 3, each of the roller assemblies 116 may include a bracket 120 that is connected to a panel 104 using, for example, one or more rivets, bolts, screws, or other fasteners. In additional embodiments, each bracket 120 may be welded to a panel 104, or attached to a panel 104 using an adhesive. Each bracket 120 may include an elongated pin member 122 that is coupled to a hub 124. The hub 124 may be configured to rotate about the pin member 122 of the bracket 120. The roller 118 may be attached to the hub 124.

Figure 4:
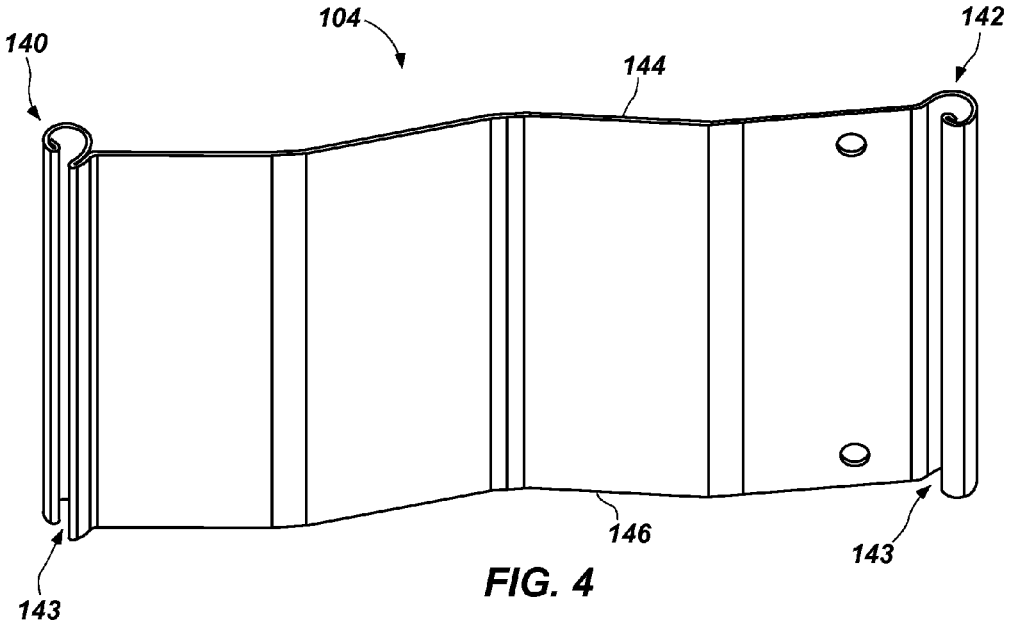
FIG. 4 is a perspective view of a portion of a single panel of the movable partition system of FIG. 1.

FIG. 4 illustrates a single panel 104 of the movable partition shown in FIG. 1. The panel 104 of FIG. 4 is identical to each of the panels 104A, 104B, 104C of FIGS. 2 and 3. In some embodiments, the panels 104 may comprise a sheet of material having an at least substantially uniform thickness that has been shaped to form the panels. In other words, the sheet of material may be designed to have a uniform thickness, although the thickness in fact may not be perfectly uniform due to the inherent capabilities of the manufacturing processes used to form the sheet of material and the panel 104. By way of example and not limitation, the panels 104 may comprise a sheet of material having an at least substantially uniform thickness of between about one half of a millimeter (0.5 mm) and about eight tenths of a millimeter (0.8 mm) (e.g., about six tenths of a millimeter (0.6 mm)).

The panels 104 may be extruded or otherwise formed to shape, or they may be formed as a generally planar sheet of material and subsequently shaped using a process such as, for example, stamping, bending, extruding, roll forming, or combinations of such processes.

The panels 104 may comprise, for example, a metal material (such as an iron or aluminum alloy), a polymer material, or a composite material (e.g., an epoxy material reinforced with glass or carbon fibers).

Figure 5:
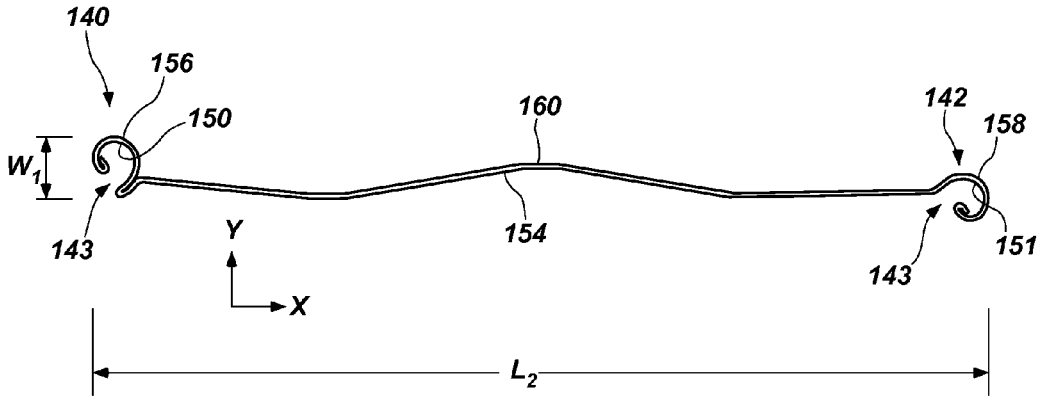
FIG. 5 is a cross-sectional view of the panel shown in FIG. 4.

As shown in FIGS. 4 and 5, each of the panels 104 includes a first lateral end 140 and an opposite, second lateral end 142. The first lateral end 140 of each panel 104 is configured to engage (i.e., couple with) a second lateral end 142 of an adjacent panel 104, and the second lateral end 140 of each panel 104 is configured to engage a first lateral end 140 of another adjacent panel 104. As shown in FIG. 4, each of the first lateral end 140 and the second lateral end 142 may comprise a generally cylindrical structure that does not form a complete cylinder, such that an opening 143 (e.g., a slit or a gap) extends linearly along a length of the generally cylindrical structure from a top edge 144 of the panel 104 to a bottom edge 146 of the panel 104 (from the perspective of FIG. 4).

As shown in FIG. 5, an inner surface 150 of the generally cylindrical structure at the first end 140 of the panel 104 and an inner surface 151 of the generally cylindrical structure at the second end 142 of the panel 104 may each comprise a portion of a first major surface 154 of the panel 104. Similarly, an outer surface 156 of the generally cylindrical structure at the first end 140 of the panel 104 and an outer surface 158 of the generally cylindrical structure at the second end 142 of the panel 104 may each comprise a portion of a second major surface 160 of the panel 104. As shown in FIG. 5, the generally cylindrical structures at each of the first and second lateral ends 140, 142 of the panel 104 may be configured such that the openings 143 are generally in a similar angular position in a plane (e.g., the XY plane in FIG. 5) oriented perpendicular to an axis extending between the top edge 144 and the bottom edge 146 of the panel 104. For example, as shown in FIG. 5, the openings 143 may be in a common angular quadrant in the plane (e.g., the third quadrant extending from 180° to 270° in the positive, counterclockwise direction from the X axis shown in FIG. 5) oriented perpendicular to an axis extending between the top edge 144 and the bottom edge 146 of the panel 104.

As also shown in FIG. 5, each panel 104 may occupy a volume of space having a length $L_1$ and a width $W_1$ (in the XY plane), as well as a height (along the Z axis (not labeled)) which may be defined as the distance the panel 104 extends between the floor and the ceiling of a room when the panel 104 is part of an installed movable partition system 100 within the room, as shown in FIG. 1.

Figure 6:
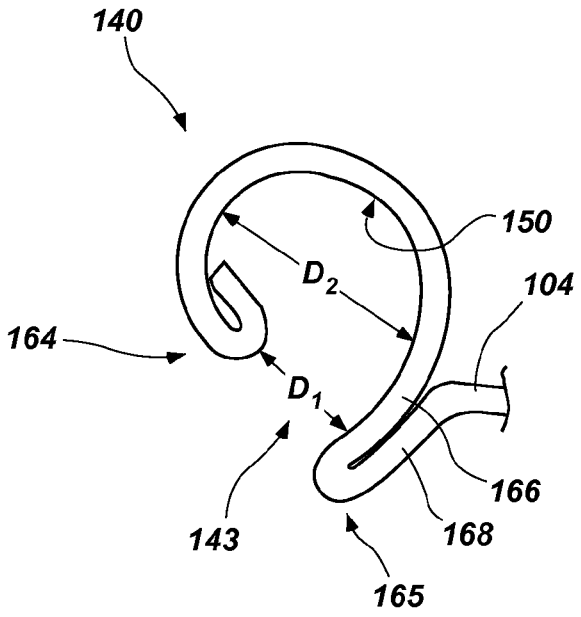
FIG. 6 is an enlarged view of a portion of FIG. 5 illustrating a first lateral end of the panel of FIGS. 4 and 5.

FIG. 6 is an enlarged view of the first lateral end 140 of the panel 140 shown in FIGS. 4 and 5. The shortest distance $D_1$ across the opening 143 to the generally cylindrical structure of the first lateral end 140 may be between about twenty percent (20%) and about sixty percent (60%) (e.g., about fifty percent (50%)) of an average diameter $D_2$ of the generally cylindrical structure of the first lateral end 140. As a non-limiting example, the average diameter $D_2$ of the generally cylindrical structure of the first lateral end 140 may be between about four millimeters (4 mm) and about nine millimeters (9 mm), and the shortest distance $D_1$ across the opening 143 to the generally cylindrical structure of the first lateral end 140 may be between about two millimeters (2 mm) and about five millimeters (5 mm).

As shown in FIG. 6, the panel 104 may have an enlarged first lateral edge 164 that has an average thickness that is between about one hundred eighty percent (180%) and about two hundred and twenty percent (220%) (e.g., about two hundred percent (200%)) of an average thickness of the panel 104. By way of example and not limitation, a lateral edge of the panel 104 may be folded over onto itself to form the enlarged first lateral edge 164 of the panel 104, as shown in FIG. 6. In other words, the enlarged first lateral edge 164 may comprise a pleated edge of the panel 104. In such embodiments, the enlarged first lateral edge 164 may have an average thickness that is about two hundred percent (200%) of an average thickness of the panel 104. In other words, the average thickness of the enlarged first lateral edge 164 may be about twice the average thickness of the panel 104.

The opening 143 to the generally cylindrical structure of the first lateral end 140 may comprise a gap between the first lateral edge 164 and the inner surface 150 of the generally cylindrical structure (or the first major surface 154 of the panel 104, which comprises the inner surface 150).

As further shown in FIG. 6, the generally cylindrical structure of the first lateral end 140 of the panel may include another edge 165 extending along the opening 143 on a side of the opening 143 opposite the enlarged first lateral edge 164. As shown in FIG. 6, the edge 165 may be formed by folding one portion 166 of the panel 104 over and onto another portion 168 of the panel 104.

Figure 7:
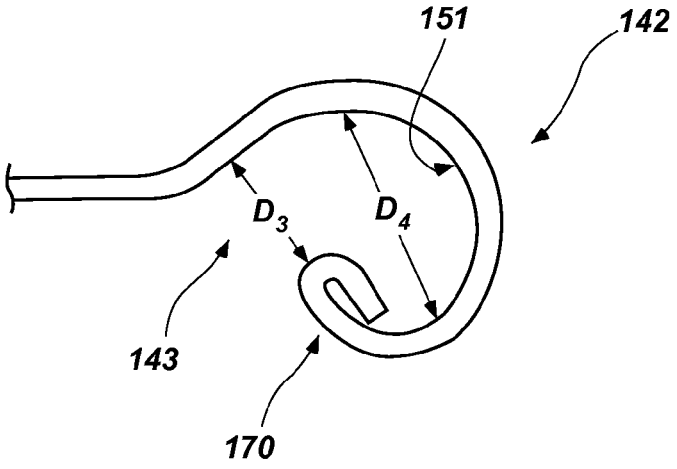
FIG. 7 is an enlarged view of another portion of FIG. 5 illustrating an opposite second lateral end of the panel of FIGS. 4 and 5.

FIG. 7 is an enlarged view of the second lateral end 142 of the panel 140 shown in FIGS. 4 and 5. The shortest distance $D_3$ across the opening 143 to the generally cylindrical structure of the second lateral end 142 may be between about twenty-five percent (25%) and about sixty-five percent (65%) (e.g., about fifty-five percent (55%)) of an average diameter $D_4$ of the generally cylindrical structure of the second lateral end 142. As a non-limiting example, the average diameter $D_4$ of the generally cylindrical structure of the second lateral end 142 may be between about three millimeters (3 mm) and about eight millimeters (8 mm), and the shortest distance $D_3$ across the opening 143 to the generally cylindrical structure of the second lateral end 142 may be between about one and a half millimeters (1.5 mm) and about four and a half millimeters (4.5 mm).

As shown in FIG. 7, the panel 104 may have an enlarged second lateral edge 170 that has an average thickness that is between about one hundred and eighty percent (180%) and about two hundred and twenty percent (220%) (e.g., about two hundred percent (200%)) of an average thickness of the panel 104. By way of example and not limitation, a lateral edge of the panel 104 may be folded over onto itself to form the enlarged second lateral edge 170 of the panel 104, as shown in FIG. 7. In other words, the enlarged second lateral edge 170 may comprise a pleated edge of the panel 104. In such embodiments, the enlarged second lateral edge 170 may have an average thickness that is about two hundred percent (200%) of an average thickness of the panel 104. In other words, the average thickness of the enlarged second lateral edge 170 may be about twice the average thickness of the panel 104.

The opening 143 to the generally cylindrical structure of the second lateral end 142 may comprise a gap between the second lateral edge 170 and the inner surface 151 of the generally cylindrical structure (or the first major surface 154 of the panel 104, which comprises the inner surface 151).

Figure 8:
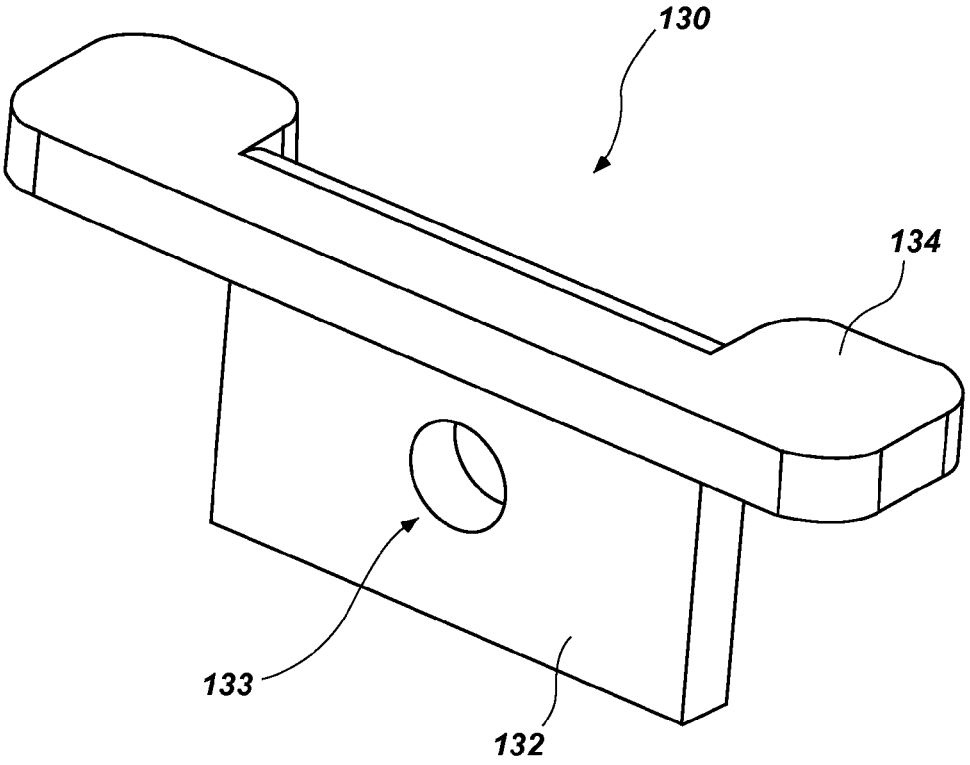
FIG. 8 is a perspective view of a retention clip of the movable partition system of FIG. 1.

FIG. 8 is a perspective view of a retention clip 130 of the movable partition system 100 of FIG. 1. As shown in FIG. 8, the retention clip 130 may comprise a side portion 132 and an end portion 134. The side portion 132 may be configured to abut against one of the first major surface 154 and the second major surface 160 of the panels 104. The side portion 132 may include one or more apertures 133 that extend therethrough to facilitate attachment of the retention clip 130 to a panel 104 using, for example, one or more rivets, bolts, screws, or other fasteners. In additional embodiments, the retention clips 130 may be welded to a panel 104, or attached to a panel 104 using an adhesive.

The side portion 132 and the end portion 134 of each retention clip 130 may be integrally formed with one another and comprise portions of an integral monolithic structure, or they may comprise discrete bodies that are attached or bonded together. The clips 130 may comprise, for example, a metal material (such as an iron or aluminum alloy), a polymer material, or a composite material (e.g., an epoxy material reinforced with glass or carbon fibers).

The clips 130 may be used to prevent unintentional separation of engaged first and second lateral ends 140, 142 of adjacent and adjoining panels 104.

Figure 9:
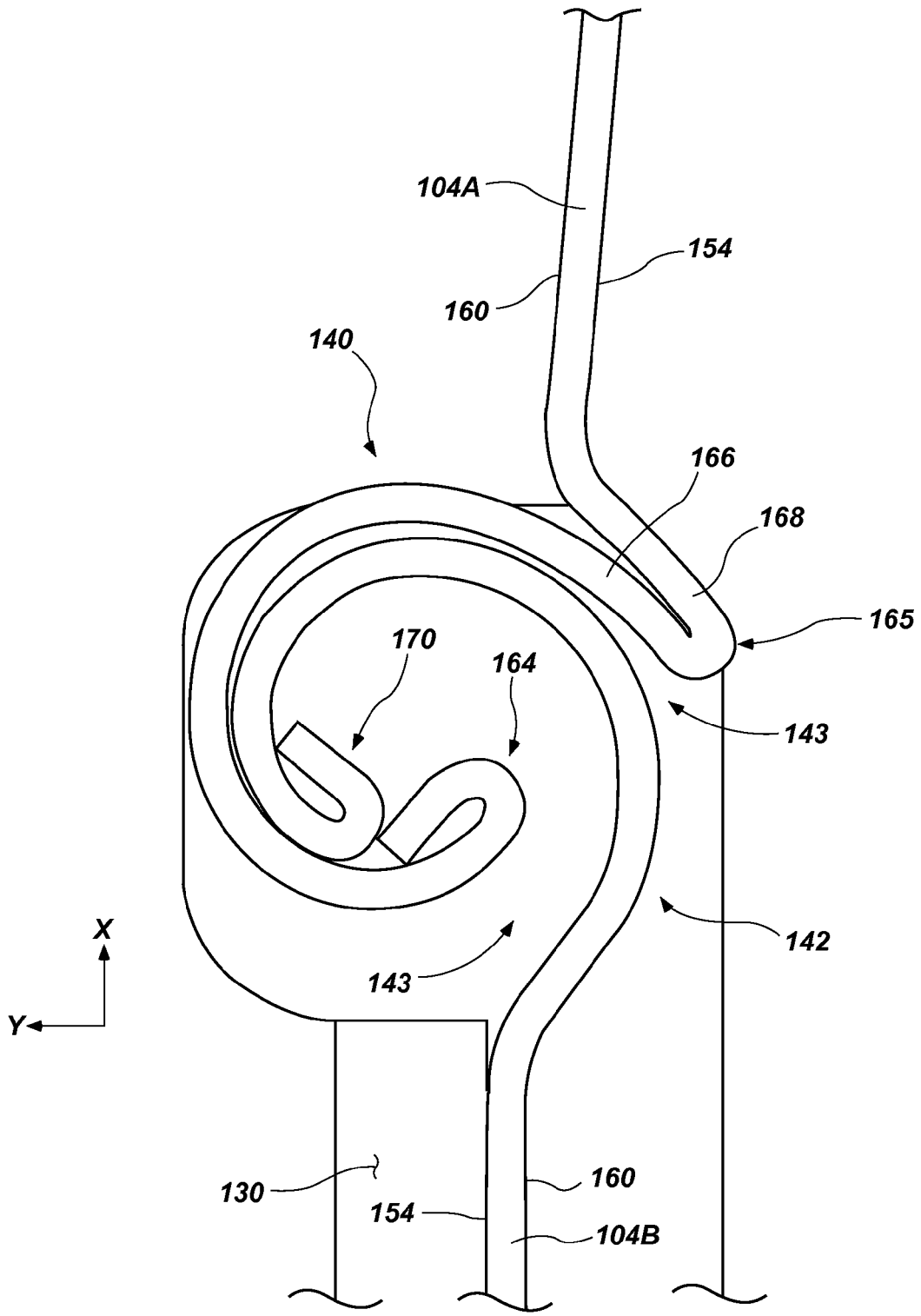
FIG. 9 is an enlarged, cross-sectional view illustrating the first lateral end of one panel engaged with the second lateral end of another adjacent and adjoining panel of the movable partition system of FIG. 1 while the panels are in the fully extended state shown in FIGS. 2 and 3.

FIG. 9 is an enlarged view illustrating a first lateral end 140 of a first panel 104A engaged with the second lateral end 142 of a second panel 104B while the panels 104A, 104B are in the fully extended state shown in FIGS. 2 and 3. To engage (i.e., couple) the panels 104A, 104B as shown in FIG. 9, the panels 104A, 104B may be placed side-by-side in a common plane such that the first lateral end 140 of the first panel 104A is located adjacent the second lateral end 142 of the second panel 104B. The panels 104A, 104B then may be oriented such that the first major surface 154 of the first panel 104A is on the same side of the sheet of the two panels 104A, 104B as the second major surface 160 of the second panel 104B, and such that the second major surface 160 of the first panel 104A is on the same side of the sheet of the two panels 104A, 104B as the first major surface 154 of the second panel 104B, as shown in FIG. 9.

The generally cylindrical structures of the first and second lateral ends 140, 142 of the adjacent panels 104A, 104B then may be slid into interlocking engagement with one another by positioning the bottom edge 146 (FIG. 4) of one of the panels 104A, 104B proximate the top edge 144 proximate the top edge 144 of the other of the panels 104A, 104B (although, it is noted that the same edge of one of the panels 104A, 104B will correspond to the top edge 144 of that panel 104A, 104B, but will correspond to the bottom edge 146 of the other of the panels 104A, 104B, since one of the panels 104A, 104B will be inverted to engage the panels 104A, 104B with one another).

The two panels 104A, 104B then may be slid relative to one another along a direction extending parallel to the longitudinal axis of the generally cylindrical structures of the first and second lateral ends 140, 142 of the panels 104A, 104B while the enlarged first lateral edge 164 of the first lateral end 140 of the first panel 104A is at least partially disposed within the interior of the generally cylindrical structure of the second lateral end 142 of the second panel 104B, and while the enlarged second lateral edge 170 of the second lateral end 142 of the second panel 104B is at least partially disposed within the interior of the generally cylindrical structure of the first lateral end 140 of the first panel 104A. Thus, when the first and second lateral ends 140, 142 of the panels 104A, 104B are engaged with one another as shown in FIG. 9, a portion of the generally cylindrical structure of the first lateral end 140 of the first panel 104A will pass through the opening 143 to the generally cylindrical structure of the second lateral end 142 of the second panel 104B, and a portion of the generally cylindrical structure of the second lateral end 142 of the second panel 104B will pass through the opening 143 to the generally cylindrical structure of the first lateral end 140 of the first panel 104A.

As shown in FIG. 9, as the first and second panels 104A, 104B are rotated relative to one another toward the fully extended state (the state shown in FIGS. 2 and 3), the enlarged second lateral edge 170 of the second lateral end 142 of the second panel 104B will abut against the enlarged first lateral edge 164 of the first lateral end 140 of the first panel 104A, which may prevent further rotation between the first and second panels 104A, 104B beyond the fully extended state.

As can be seen in FIGS. 2, 3, and 9, in some embodiments, the generally cylindrical structure of the first lateral end 140 of the first panel 104A and the generally cylindrical structure of the second lateral end 142 of the second panel 104B (as well as the enlarged first lateral edge 164 of the first panel 104A and the enlarged second lateral edge 170 of the second panel 104B) may be sized and configured to cause the first panel 104A and the second panel 104B to be at least substantially coplanar (i.e., located in a common plane) in the fully extended state shown in FIGS. 2, 3, and 9.

The generally cylindrical structure of the first lateral end 140 of the first panel 104A and the generally cylindrical structure of the second lateral end 142 of the second panel 104B (as well as the enlarged first lateral edge 164 of the first panel 104A and the enlarged second lateral edge 170 of the second panel 104B) also may be sized and configured such that the generally cylindrical structure of the first lateral end 140 of the first panel 104A and the generally cylindrical structure of the second lateral end 142 of the second panel 104B will not become disengaged from one another due to any lateral forces that might act upon the panels 104A, 104B in directions generally perpendicular to the longitudinal axis of the generally cylindrical structures (i.e., in directions within the XY plane shown in FIG. 9) while the panels 104A, 104B are in the fully extended state.

After engaging the generally cylindrical structure of the first lateral end 140 of the first panel 104A and the generally cylindrical structure of the second lateral end 142 of the second panel 104B, one or more retention clips 130 may be attached to one or both of the panels 104A, 104B to prevent undesirable separation (i.e., decoupling) of the generally cylindrical structures of the first and second lateral ends 140, 142 of the panels 104A, 104B.

Figure 10:
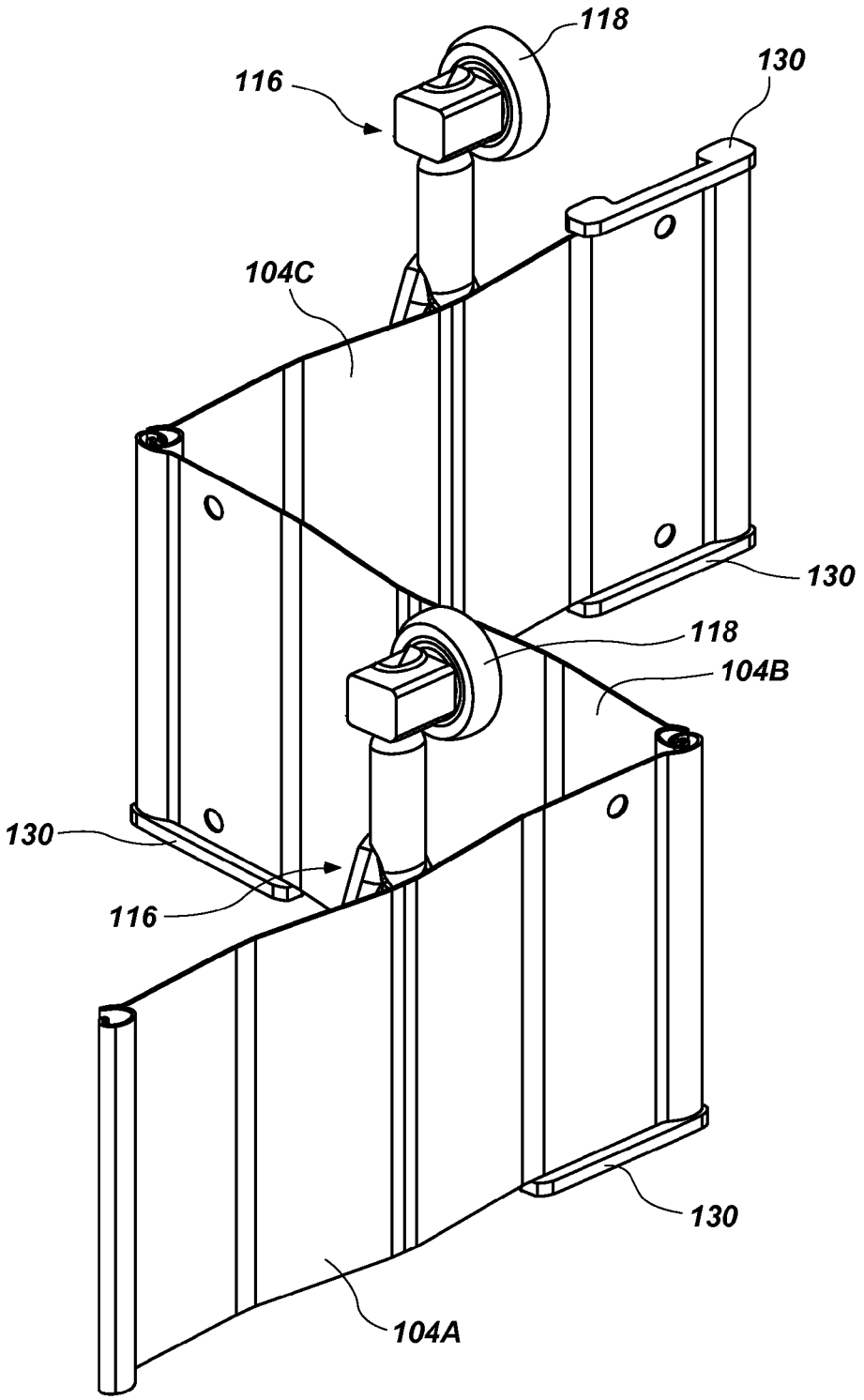
FIG. 10 is simplified perspective view of the series of assembled panels of FIGS. 2 and 3 shown in a partially extended state.

FIG. 10 is simplified perspective view of the series of assembled panels 104A, 104B, 104C of FIGS. 2 and 3 shown in a partially extended state (or a partially collapsed state). As shown in FIG. 10, as the movable partition 102 of the movable partition system 100 of FIG. 1 is moved from a fully extended state (like that shown in FIGS. 2 and 3) to a collapsed or stored state, the panels 104 (e.g., panels 104A, 104B, 104C) will begin to rotate relative to one another and fold in an accordion-type manner.

Figure 11:
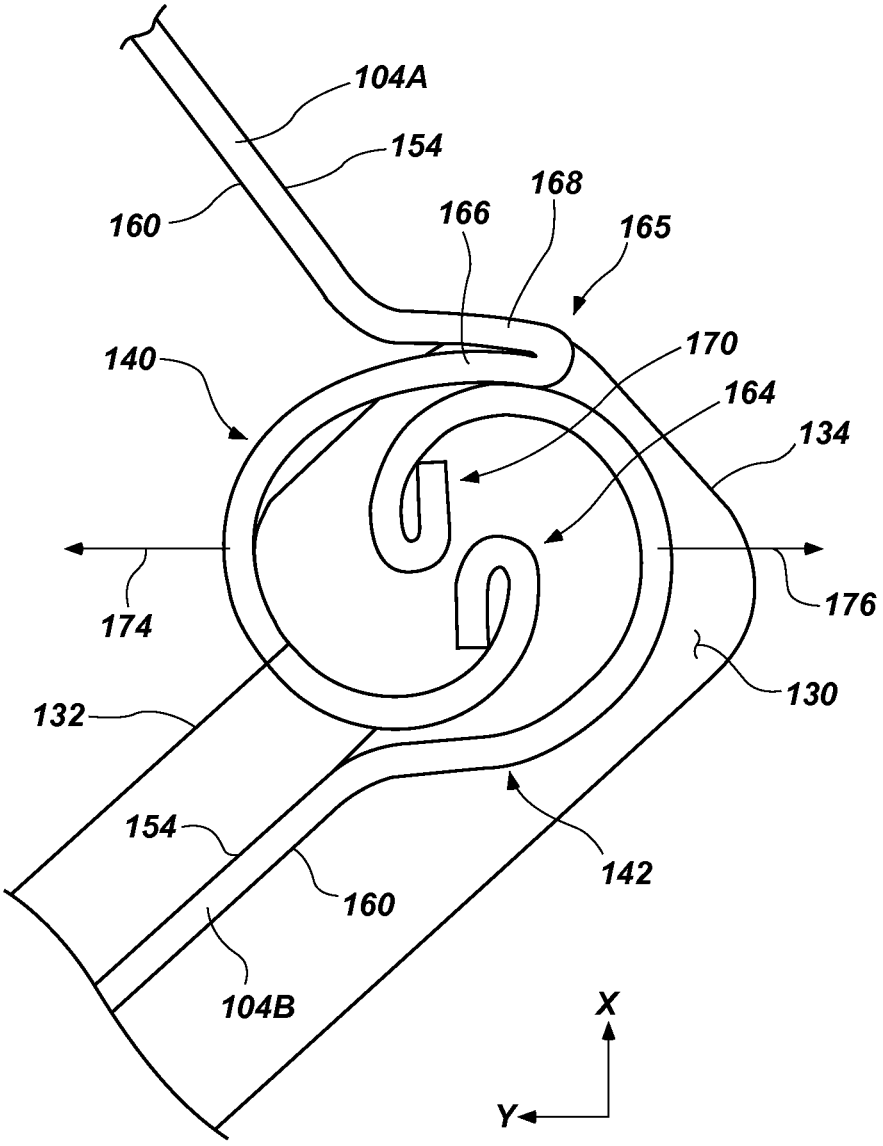
FIG. 11 is an enlarged, cross-sectional view similar to FIG. 9 illustrating the first lateral end of one panel engaged with the second lateral end of another adjacent and adjoining panel of the movable partition system of FIG. 1 while the panels are in the partially extended state shown in FIG. 10.

FIG. 11 is an enlarged view illustrating the first lateral end 140 of the first panel 104A engaged with the second lateral end 142 of the second panel 104B while the panels 104A, 104B are in the partially extended state shown in FIG. 10. The first panel 104A is oriented at an angle of approximately forty-five degrees (45°) in the configuration of FIGS. 10 and 11. The generally cylindrical structure of the first lateral end 140 of the first panel 104A and the generally cylindrical structure of the second lateral end 142 of the second panel 104B (as well as the enlarged first lateral edge 164 of the first panel 104A and the enlarged second lateral edge 170 of the second panel 104B) may be sized and configured such that, in the absence of the retention clips 130, it is possible to disengage the generally cylindrical structure of the first lateral end 140 of the first panel 104A from the generally cylindrical structure of the second lateral end 142 by applying lateral forces between the panels 104A, 104B in directions generally perpendicular to the longitudinal axis of the generally cylindrical structures (i.e., in directions within the XY plane shown in FIG. 9, such as by applying a force to the first panel 104A in the direction of arrow 174 and applying a force to the second panel 104B in the direction of arrow 176). In other words, the generally cylindrical structure of the first lateral end 140 of the first panel 104A and the generally cylindrical structure of the second lateral end 142 of the second panel 104B (as well as the enlarged first lateral edge 164 of the first panel 104A and the enlarged second lateral edge 170 of the second panel 104B) may be sized and configured to allow disengagement of the panels 104A, 104B from one another by removing retention clips 130 from the panels 104A, 104B, orienting the panels 104A, 104B at an angle relative to one another (e.g., an angle of about (90°), and applying a separation force or forces between the first panel 104A and the second panel 104B, as previously described and illustrated in FIG. 11. In this configuration, removal, repair, and/or replacement of one or more panels 104 in the movable partition 102 (FIG. 1) may be facilitated without requiring significant disassembly of the movable partition 102.

As shown in FIG. 11, the retention clip 130 may be sized and configured such that the side portion 132 of the retention clip 130 will abut against at least one of the generally cylindrical structures of the first lateral end 140 and the second lateral end 142 of the panels 104A, 104B in such a manner as to prevent disengagement therebetween when the retention clip 130 is attached to at least one of the panels 104A, 104B, as shown in FIG. 11. Furthermore, the retention clip 130 may be sized and configured such that the end portion 134 of the retention clip 130 will abut against the longitudinal ends of the generally cylindrical structures of the first lateral end 140 and the second lateral end 142 of the panels 104A, 104B in such a manner as to prevent either of the generally cylindrical structures from sliding longitudinally beyond the retention clip 130 when the retention clip 130 is attached to at least one of the panels 104A, 104B, as shown in FIG. 11.

One advantage of certain embodiments of the present invention is that, as the panels 104A, 104B are folded from an extended state toward a collapsed state, gaps are provided between the adjacent and adjoining panels 104A, 104B. As previously mentioned, movable partitions 102 may include two sheets of panels 104 disposed side-by-side. Since the enclosed volume of space between such sheets of panels 104 may be greater when the movable partition 102 is in an extended state relative to when the movable partition 102 is in the collapsed state, as the movable partition 102 is collapsed, it may be desirable to allow the air within the enclosed space between such sheets of panels 104 to vent or exhaust out from the space within the movable partition. By providing gaps between the adjacent and adjoining panels 104A, 104B when the panels 104A, 104B are folded from an extended state toward a collapsed state, the air within the movable partition 102 may be allowed to vent or exhaust out from the movable partition 102 through the gaps as the movable partition 102 is collapsed.

Figure 12:
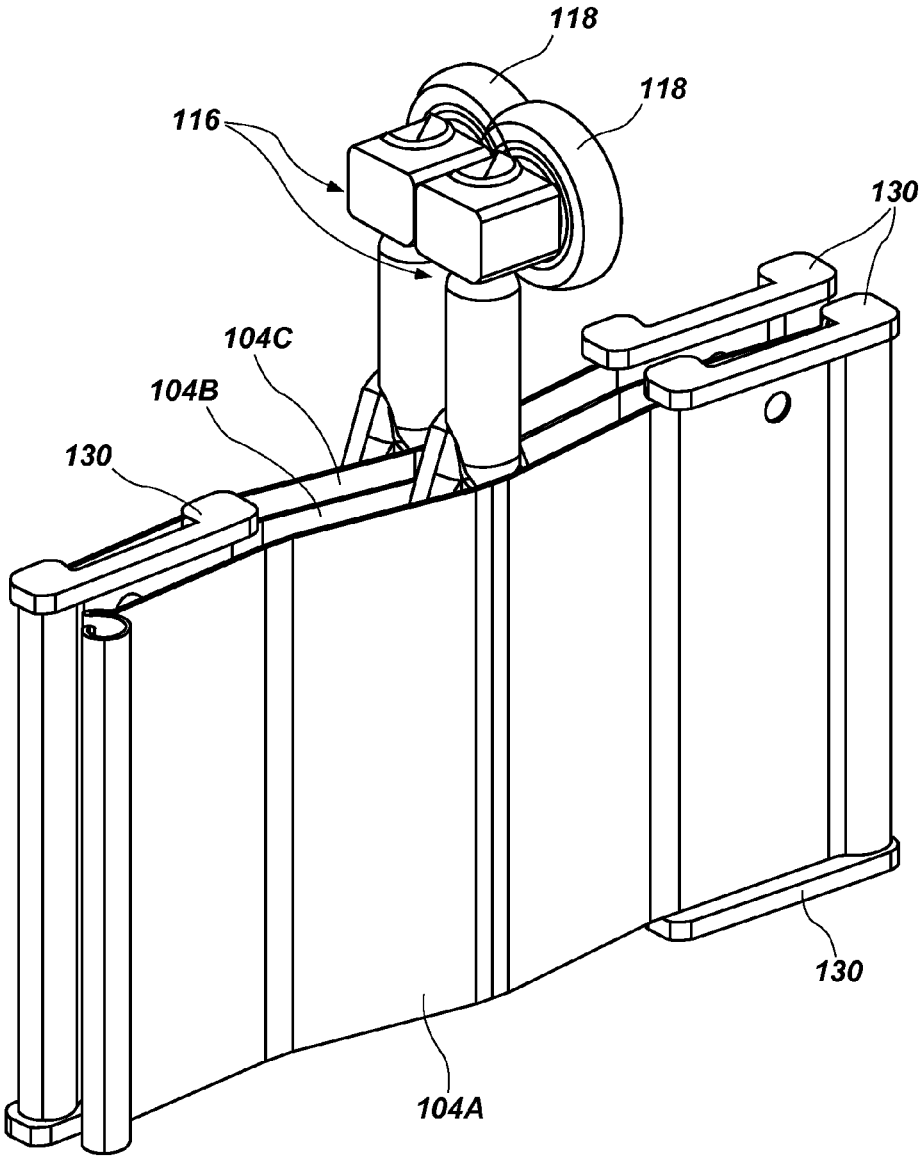
FIG. 12 is a simplified perspective view of the series of assembled panels of FIGS. 2 and 3 shown in a fully collapsed or retracted state.
Figure 13:
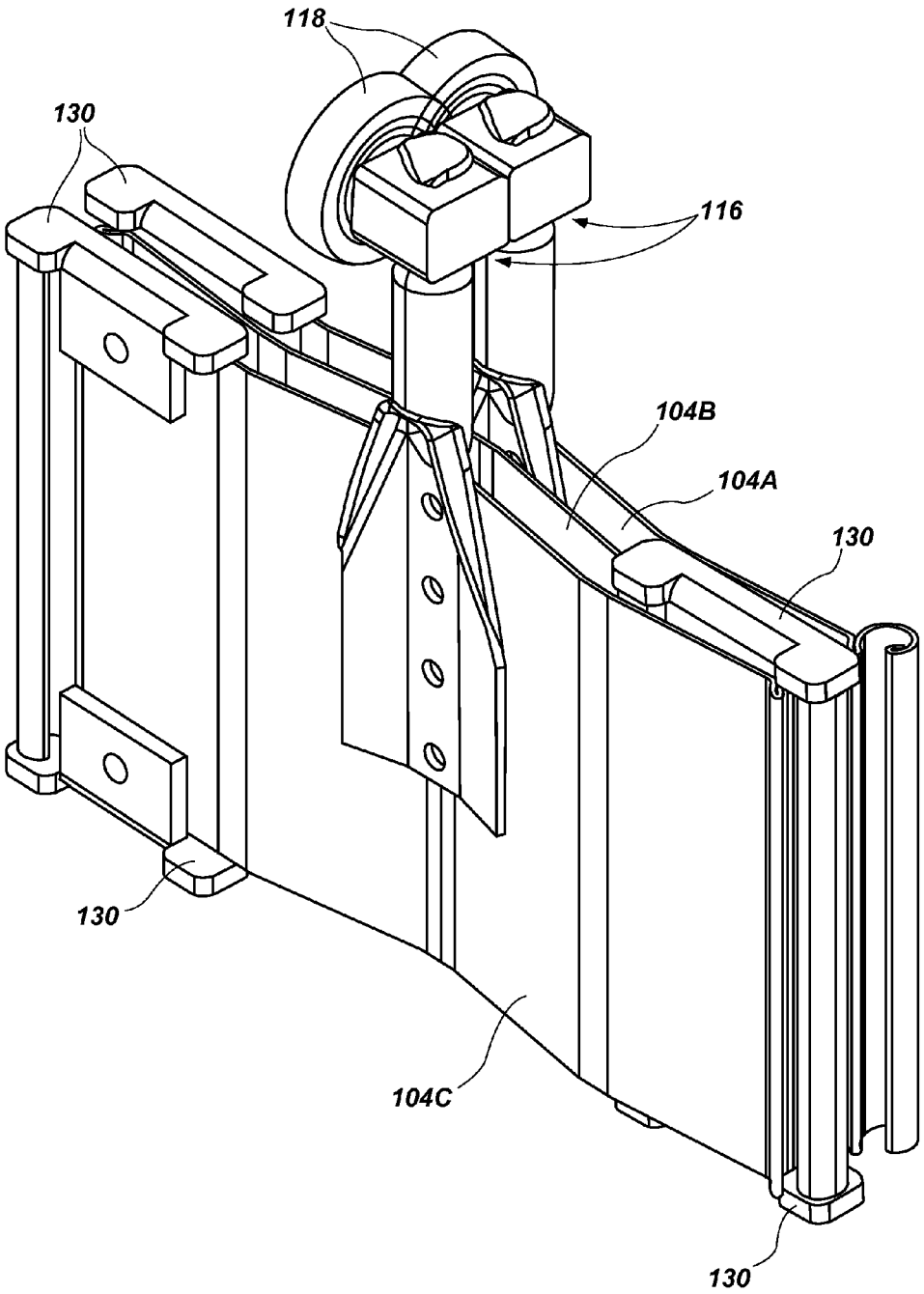
FIG. 13 is another simplified perspective view of the series of assembled panels of FIG. 12 in the fully collapsed state.
Figure 14:
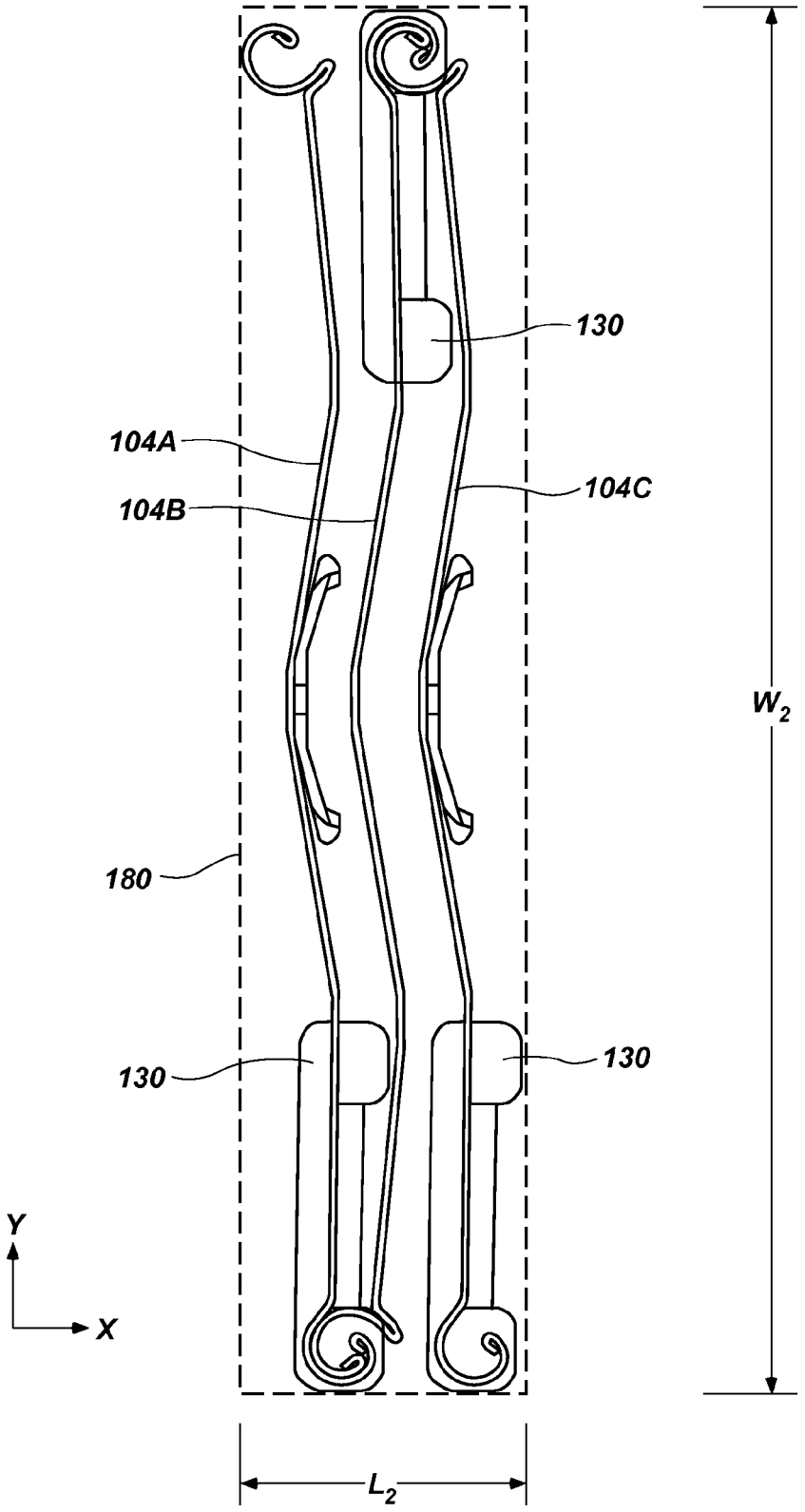
FIG. 14 is a cross-sectional view of the series of assembled panels of FIGS. 12 and 13 in the fully collapsed state.

FIGS. 12 and 13 are perspective views of the panels 104A, 104B, 104C of FIGS. 2, 3, and 10 from opposite sides thereof, and illustrate the panels 104A, 104B, 104C in a fully collapsed state. FIG. 14 is a cross-sectional view of the panels 104A, 104B, 104C in the fully collapsed state shown in FIGS. 12 and 13. As shown in FIG. 14, in the fully collapsed state, the stack of panels 104A, 104B, 104C may occupy a volume of space generally represented by the dashed line 180. This volume of space 180 may have a length $L_2$ and a width $W_2$ (in the XY plane), as well as a height (along the Z axis (not labeled)), which may be defined as the distance the stack of panels 104A, 104B, 104C extends between the floor and the ceiling of a room when the panels 104A, 104B, 104C are part of an installed movable partition system 100 within the room. As can be appreciated by a comparison of FIGS. 5 and 14, the width $W_2$ of the volume of space 180 (FIG. 14) of the stack of panels 104A, 104B, 104C may be approximately equal to the length $L_1$ of each of the individual panels 104A, 104B, 104C.

In accordance with some embodiments of the invention, the ratio of the length $L_2$ of the volume of space 180 occupied by a sheet of panels 104 in the fully collapsed state to the overall length of the sheet of panels 104 in the fully extended state (like that shown in FIGS. 2 and 3) may be about 0.16 or less, about 0.10 or less, about 0.08 or less, about 0.0625 or less, about 0.05 or less, or even about 0.0375 or less.

Figure 15:
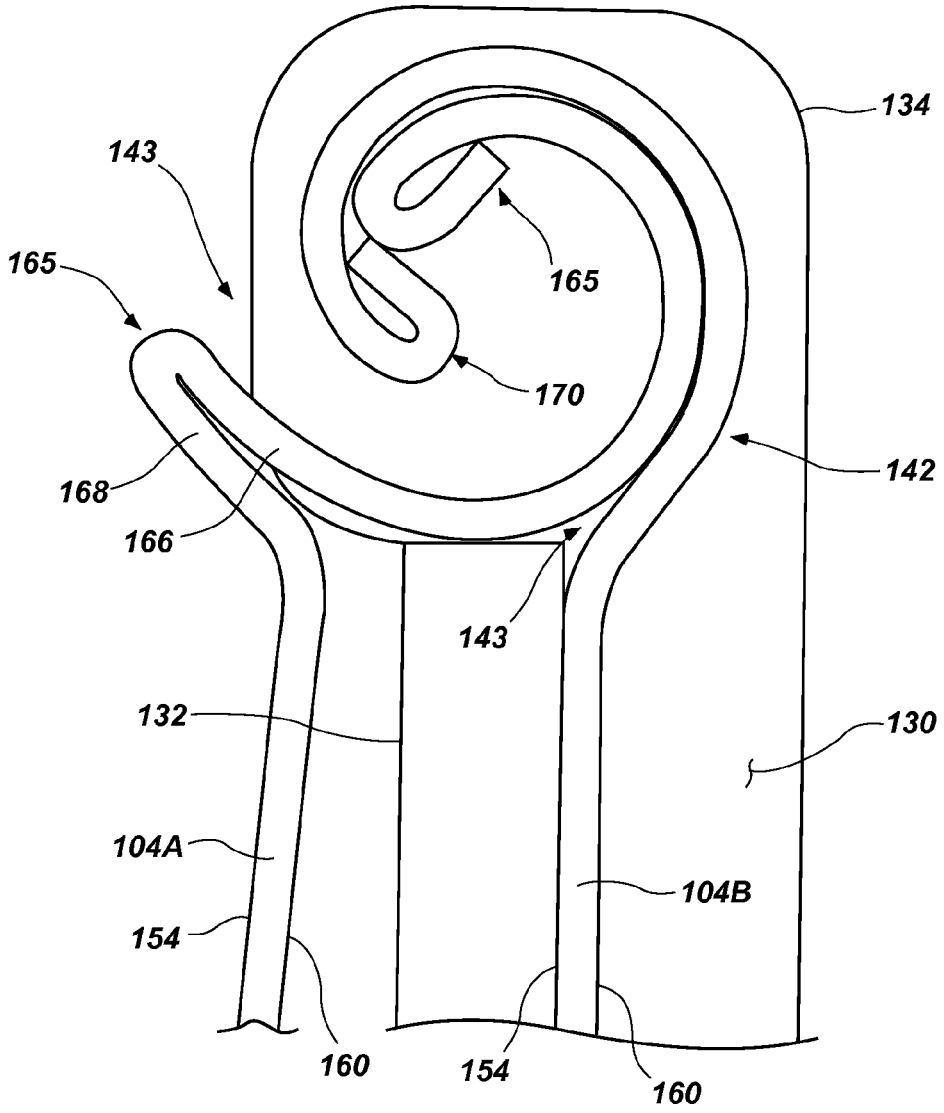
FIG. 15 is an enlarged, cross-sectional view illustrating the first lateral end of one panel engaged with the second lateral end of another adjacent and adjoining panel of the movable partition system of FIG. 1 while the panels are in the fully collapsed state shown in FIGS. 12 through 14.

FIG. 15 is an enlarged view illustrating the first lateral end 140 of the first panel 104A engaged with the second lateral end 142 of the second panel 104B while the panels 104A, 104B are in the fully collapsed state shown in FIGS. 12 through 14. The first panel 104A is oriented at an angle of approximately one hundred and eighty degrees (180°) in the configuration of FIGS. 12 through 15.

As shown in FIG. 15, when the first and second lateral ends 140, 142 of the adjoining panels 104A, 104B are engaged with one another, a portion of the generally cylindrical structure of the first lateral end 140 of the first panel 104A will pass through the opening 143 to the generally cylindrical structure of the second lateral end 142 of the second panel 104B, and a portion of the generally cylindrical structure of the second lateral end 142 of the second panel 104B will pass through the opening 143 to the generally cylindrical structure of the first lateral end 140 of the first panel 104A.

As shown in FIG. 15, as the first and second panels 104A, 104B are rotated relative to one another toward the fully collapsed state (the state shown in FIGS. 12 through 14), the enlarged first lateral edge 164 of the first lateral end 140 of the first panel 104A will abut against the enlarged second lateral edge 170 of the second lateral end 142 of the second panel 104B, which may prevent further rotation between the first and second panels 104A, 104B beyond the fully collapsed state.

As can be seen in FIGS. 12 through 14, in some embodiments, the generally cylindrical structure of the first lateral end 140 of the first panel 104A and the generally cylindrical structure of the second lateral end 142 of the second panel 104B (as well as the enlarged first lateral edge 164 of the first panel 104A and the enlarged second lateral edge 170 of the second panel 104B) may be sized and configured to cause the first panel 104A and the second panel 104B to be oriented at least substantially parallel with one another in the fully collapsed state shown in FIGS. 12 through 14.

The generally cylindrical structure of the first lateral end 140 of the first panel 104A and the generally cylindrical structure of the second lateral end 142 of the second panel 104B (as well as the enlarged first lateral edge 164 of the first panel 104A and the enlarged second lateral edge 170 of the second panel 104B) also may be sized and configured such that the generally cylindrical structure of the first lateral end 140 of the first panel 104A and the generally cylindrical structure of the second lateral end 142 will not become disengaged from one another due to any lateral forces that might act upon the panels 104A, 104B in directions generally perpendicular to the longitudinal axis of the generally cylindrical structures (i.e., in directions within the XY plane shown in FIG. 15) while the panels 104A, 104B are in the fully collapsed state.

Figure 16:
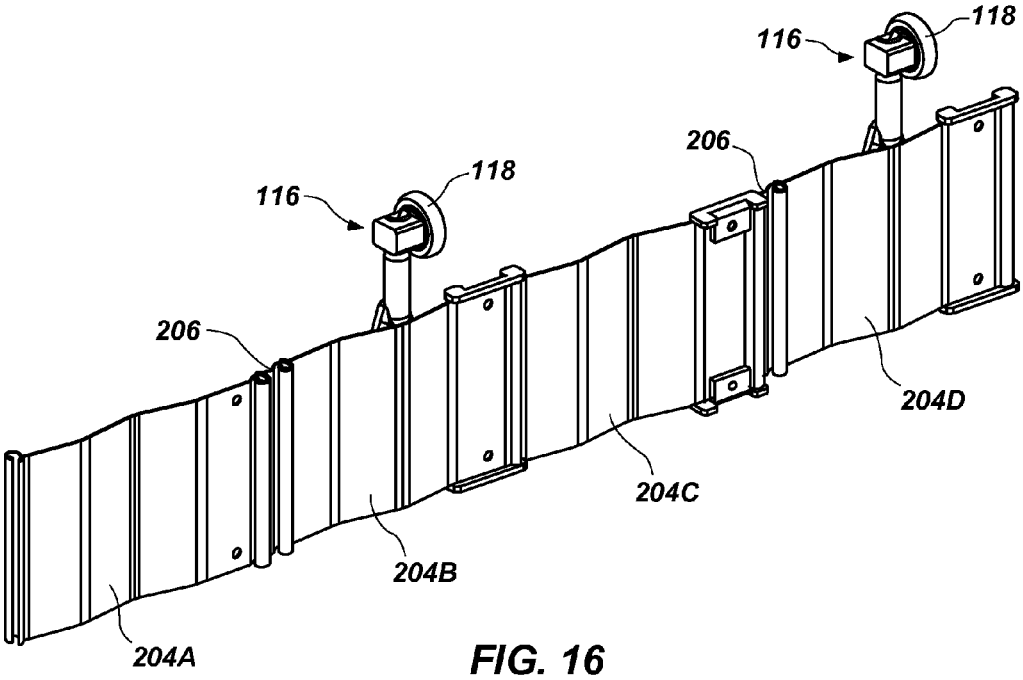
FIG. 16 is a perspective view of another series of assembled panels, which are shown in a fully extended state, some of which panels are connected together using hinge members therebetween in accordance with additional embodiments of movable partition systems of the present invention.

FIG. 16 is a simplified illustration of a portion of another sheet of panels 204A-204D that may be used in the movable partition 102 of FIG. 1. Some of the panels 204A-204D are coupled together using hinge members 206, as discussed in further detail below. The height of the panels 204A-204D and the hinge members 206 has been reduced in FIG. 16 (as in FIGS. 2 and 3) to facilitate illustration and description of the various features of the panels 204A-204D and the hinge members 206. The panels 204A-204D may be identical to the panels 104A-104C previously described with reference to FIGS. 2 through 7.

As shown in FIG. 16, however, every other joint along the sheet of panels 204A-204D includes a hinge member 206. For example, as shown in FIG. 16, a lateral end of the first panel 204A is indirectly connected to a first lateral end of the second panel 204B using a hinge member 206. A second lateral end of the second panel 204B is directly connected to a first lateral end of the third panel 204C (in the manner previously described in relation to the panels 104A-104C) without the use of a hinge member 206. A second lateral end of the third panel 204C is indirectly connected to a lateral end of the fourth panel 204D using another hinge member 206.

One or more retention clips 130 may be used to prevent unwanted, inadvertent separation of any of the joints between the panels 104A-104D and/or the joints between the panels 104A-104D and the hinge members 206.

Figure 17:
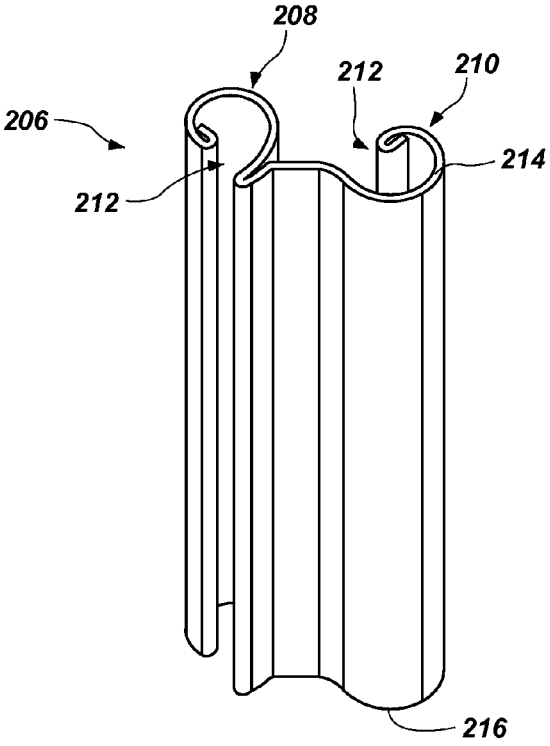
FIG. 17 is an enlarged perspective view of a hinge member of FIG. 16.

FIG. 17 illustrates a single hinge member 206 like those shown in FIG. 16. In some embodiments, the hinge members 206 may comprise a sheet of material having an at least substantially uniform thickness that has been shaped to form the hinge members 206. By way of example and not limitation, the hinge members 206 may comprise a sheet of material having an at least substantially uniform thickness of between about one-half of a millimeter (0.5 mm) and about eight tenths of a millimeter (0.8 mm) (e.g., about six tenths of a millimeter (0.6 mm)). Thus, the hinge members 206 may be generally similar in configuration to the panels 204A-204D and the panels 104A-104C previously described herein. In particular, the hinge members 206 may be formed from the same materials that may be used to form the panels 204A-204D and the panels 104A-104C, and the hinge members 206 may be formed using the same methods that may be used to form the panels 204A-204D and the panels 104A-104C.

Figure 18:
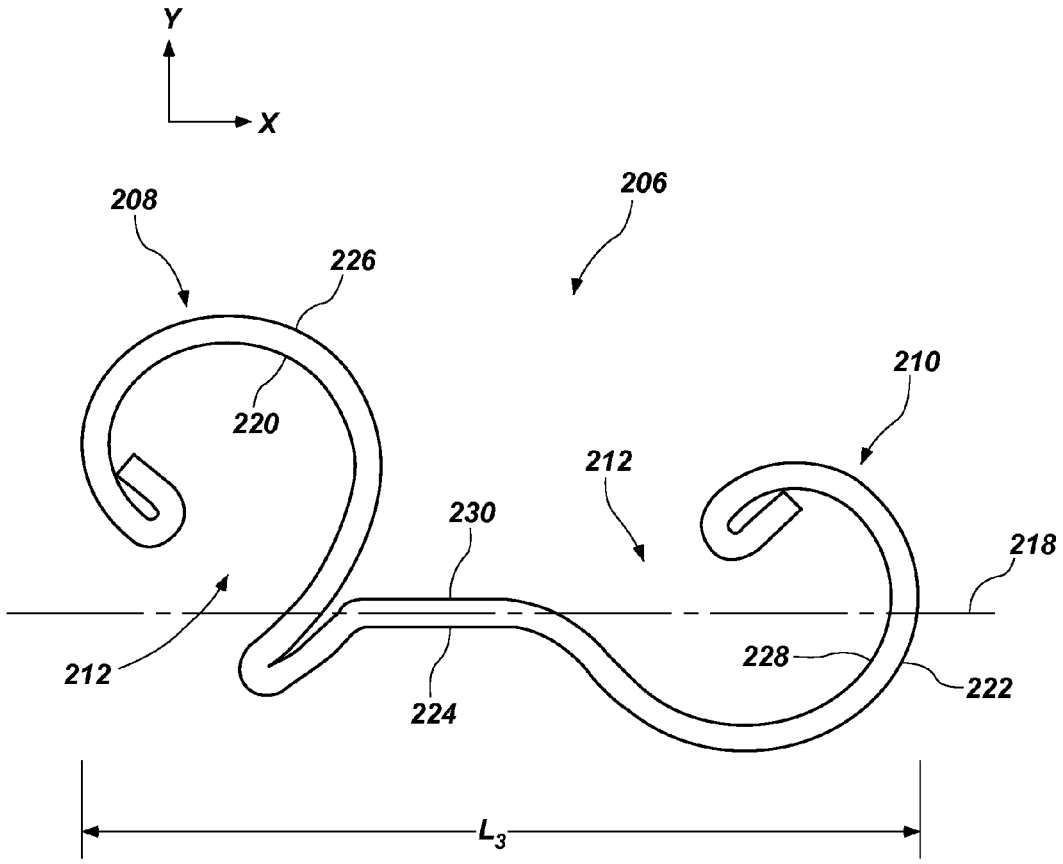
FIG. 18 is a cross-sectional view of the hinge member of FIG. 17.

As shown in FIGS. 17 and 18, each of the hinge members 206 includes a first lateral end 208 and an opposite, second lateral end 210. The first lateral end 208 of each hinge member 206 is configured to engage (i.e., couple with) a second lateral end 142 of an adjacent panel 204A-204D, and the second lateral end 210 of each hinge member 206 is configured to engage a first lateral end 208 of another adjacent panel 204A-204D. As shown in FIG. 18, each of the first lateral end 208 and the second lateral end 210 of the hinge member 206 may be at least substantially identical to the first lateral ends 140 and the second lateral ends 142 of the panels 104A-104C, as previously described in relation to FIGS. 4 through 7. Thus, each of the first lateral ends 208 and the second lateral ends 210 of the hinge members 206 may comprise a generally cylindrical structure, but that is not a complete cylinder, such that an opening 212 (e.g., a slit) extends linearly along a length of the generally cylindrical structure from a top edge 214 of the hinge member 206 to a bottom edge 216 of the hinge member 206 (from the perspective of FIG. 17).

The hinge members 206 may differ from the panels 204A-204D and the panels 104A-104C in that the hinge members 206 may have a length $L_3$ that is significantly shorter than the length $L_1$ (FIG. 5) of the panels 104A-104C and the panels 204A-204D. Furthermore, as can be seen by comparing FIG. 18 with FIG. 5, the configuration of one of the first lateral ends 208 and the second lateral ends 210 may be configured as mirror images of the corresponding first lateral ends 140 or second lateral ends 142 of the panels 204A-204D relative to a plane 218 that extends vertically therethrough, as shown in FIG. 18.

Thus, in this configuration, an inner surface 220 of the generally cylindrical structure at the first lateral end 208 of the hinge member 206 and an outer surface 222 of the generally cylindrical structure at the second lateral end 210 of the hinge member 206 may each comprise a portion of a first major surface 224 of the hinge member 206. Similarly, an outer surface 226 of the generally cylindrical structure at the first lateral end 208 of the hinge member 206 and an inner surface 228 of the generally cylindrical structure at the second lateral end 210 of the hinge member 206 may each comprise a portion of a second major surface 230 of the hinge member 206. As shown in FIG. 18, the generally cylindrical structures at each of the first and second lateral ends 208, 210 of the hinge member 206 may be configured such that the openings 212 are in different angular positions in a plane (e.g., the XY plane in FIG. 18) oriented perpendicular to an axis extending between the top edge 214 and the bottom edge 216 (FIG. 17) of the hinge member 206. For example, as shown in FIG. 18, the openings 212 may be in different angular quadrants in the plane oriented perpendicular to an axis extending between the top edge 214 and the bottom edge 216 of the hinge member 206. As a non-limiting example, the opening 212 to the generally cylindrical structure at the first lateral end 208 may be in the third quadrant extending from 180° to 270° in the positive, counterclockwise direction from the X axis shown in FIG. 18, and the opening 212 to the generally cylindrical structure at the second lateral end 210 may be in the second quadrant extending from 90° to 180° in the positive, counterclockwise direction from the X axis shown in FIG. 18.

Figure 19:
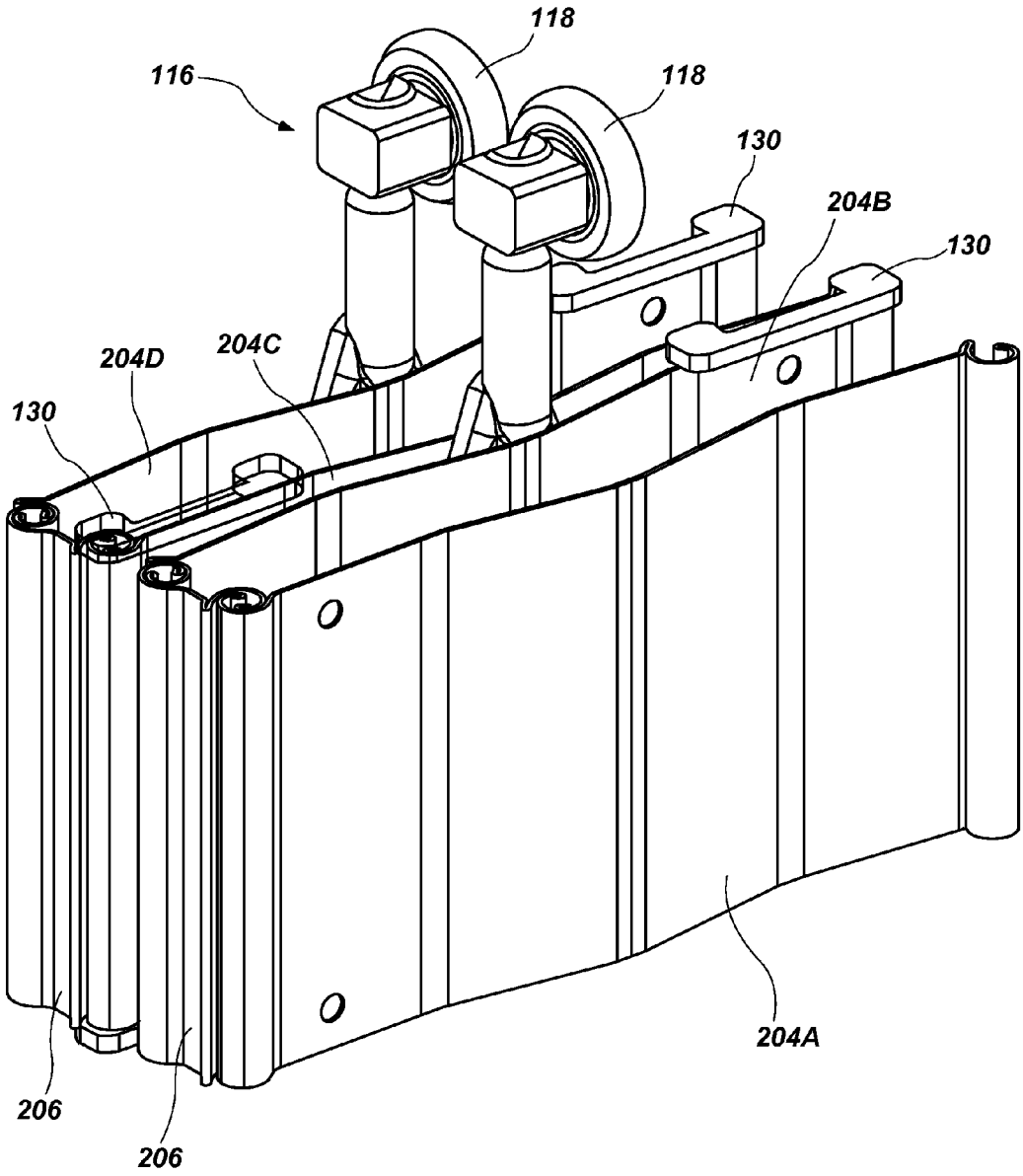
FIG. 19 is a simplified perspective view of the series of assembled panels of FIG. 16 shown in a fully collapsed state.

In the configuration described above, the sheet of panels 204A-204D and hinge members 206 will fold in an accordion style manner from the fully extended state shown in FIG. 16 to the fully collapsed state shown in FIG. 19.

Figure 20:
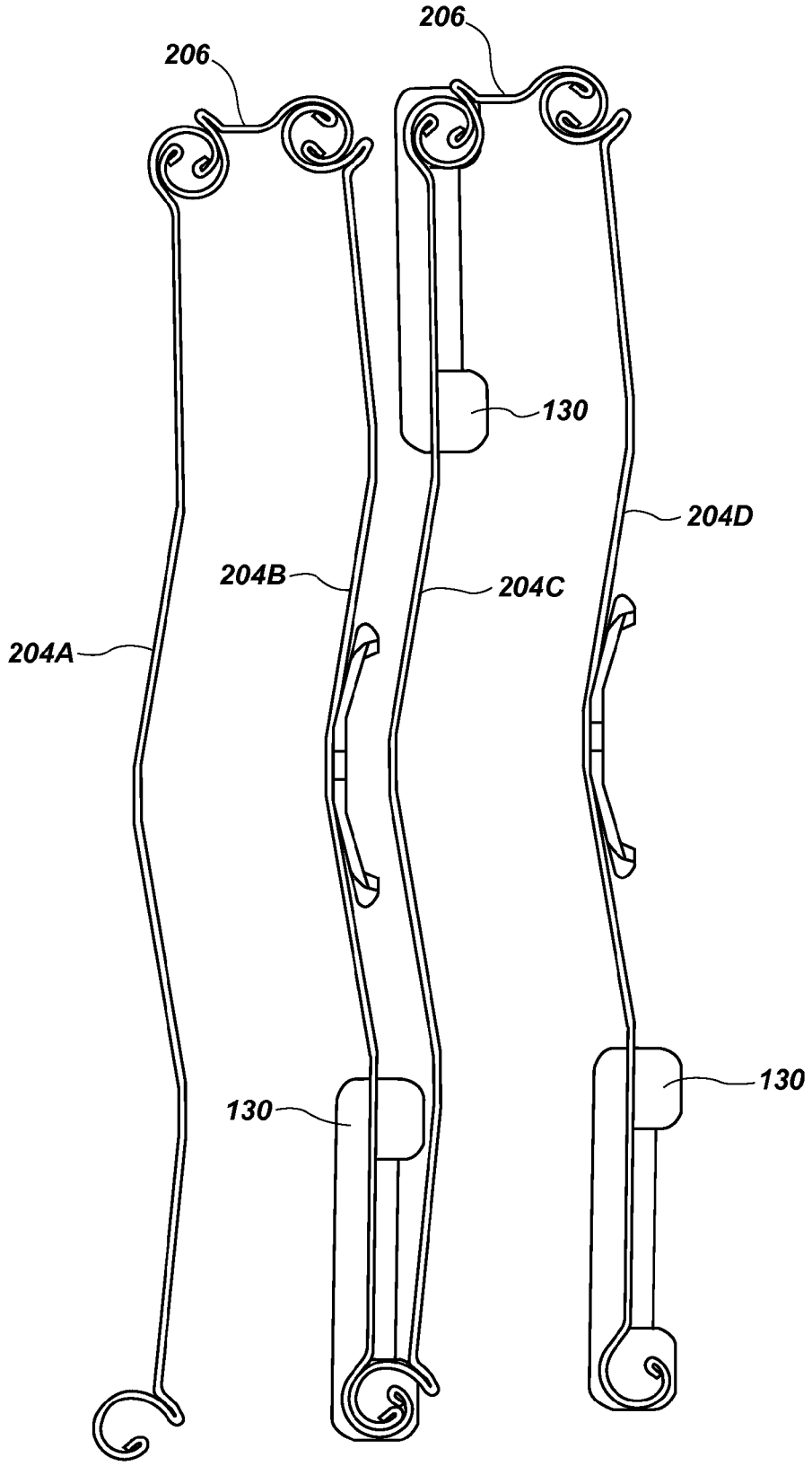
FIG. 20 is a cross-sectional view of the series of assembled panels of FIGS. 16 and 19 in the fully collapsed state of FIG. 19.
Figure 21:
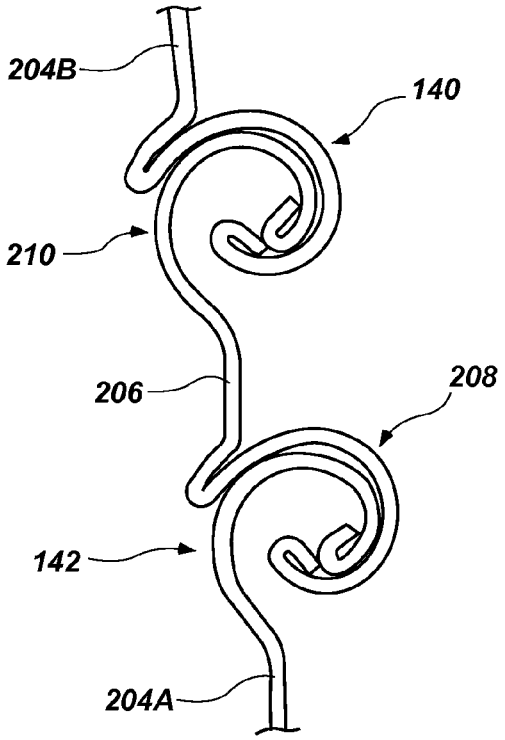
FIG. 21 is a cross-sectional view illustrating the lateral ends of a hinge member like that of FIGS. 17 and 18 connected to the lateral ends of adjacent and adjoining panels while the panels are in the fully extended state shown in FIG. 16.
Figure 22:
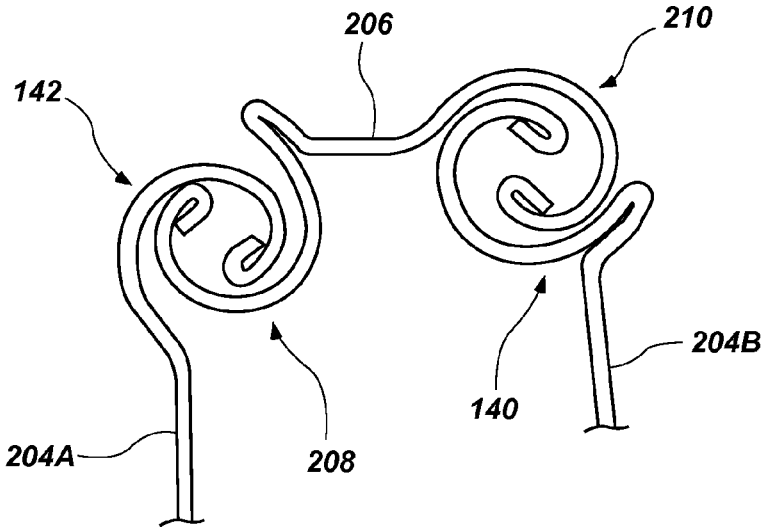
FIG. 22 is a cross-sectional view illustrating the lateral ends of a hinge member like that of FIGS. 17 and 18 connected to the lateral ends of adjacent and adjoining panels while the panels are in the fully collapsed state shown in FIGS. 19 and 20.

FIG. 20 is similar to FIG. 14 and is a cross-sectional view of the panels 204A-204D in the fully collapsed state shown in FIG. 19. FIG. 21 is an enlarged view illustrating a second lateral end 142 of a first panel 204A engaged with the first lateral end 208 of a hinge member 206, and the second lateral end 210 of the hinge member 206 engaged with the first lateral end 140 of a second panel 204B, while the panels 204A, 204B and the hinge 206 are in the fully extended state shown in FIG. 16. FIG. 22 is an enlarged view like that of FIG. 21 and illustrates the panels 204A, 204B and the hinge member 206 in the fully collapsed state shown in FIGS. 19 and 20.

Referring again to FIG. 1, although the movable partitions 102 of embodiments of the present invention may comprise panels 104 that are configured to be capable of extending to a fully extended state in which the panels 104 are at least substantially coplanar as illustrated in FIGS. 2 and 3, it should be understood that, when installed, the length of space across which the panels 104 extend may be shorter than the entire length of the assembled sheet of panels 104 in their fully extended state. Thus, when the movable partition 102 is "fully extended" across a room in which the movable partition 102 is installed, the panels may not be in their "fully extended state" illustrated in FIGS. 2 and 3, although the panels 104 are capable of extending to a fully extended state as shown in FIGS. 2 and 3.

While the invention may be susceptible to various modifications and alternative forms, specific embodiments have been shown by way of example in the drawings and have been described in detail herein. However, it should be understood that the invention is not intended to be limited to the particular forms disclosed. Rather, the invention includes all modifications, equivalents, and alternatives falling within the spirit and scope of the invention as defined by the following appended claims.

What is claimed is:

1. A movable partition, comprising:

a sheet of panels configured to extend to an extended state and to fold in an accordion fashion to a retracted state, the sheet of panels comprising at least one hinge member, each of the panels and the at least one hinge member of the sheet of panels comprising:

a top edge;

a bottom edge;

a first major surface;

an opposite, second major surface;

an enlarged first lateral edge;

an enlarged second lateral edge;

a first lateral end extending between the top edge and the bottom edge, the first lateral end comprising a first generally cylindrical structure, the first generally cylindrical structure comprising a first opening extending linearly between the top edge and the bottom edge, the first opening comprising a gap between the enlarged first lateral edge and the first major surface; and an opposite, second lateral end extending between the top edge and the bottom edge, the second lateral end comprising a second generally cylindrical structure, the second generally cylindrical structure comprising a second opening extending linearly between the top edge and the bottom edge, the second opening comprising a gap between the enlarged second lateral edge and one of the first major surface and the opposite, second major surface;

wherein the first lateral end of the at least one hinge member is engaged with the second lateral end of a panel of the sheet of panels, wherein a length of each panel of the sheet of panels between the first lateral end and the second lateral end thereof is greater than a length of the at least one hinge member between the first lateral end and the second lateral end thereof, and wherein each panel of the sheet of panels is connected to a hinge member at one of the first or second lateral end of the panel of the sheet of panels and to another panel of the sheet of panels at the other of the first or second lateral end of the panel of the sheet of panels.

2. The movable partition of claim 1, wherein the second lateral end of the at least one hinge member is engaged with the first lateral end of another panel of the sheet of panels.

3. The movable partition of claim 1, wherein the at least one hinge member comprises a sheet of material having an at least substantially uniform thickness, the sheet of material shaped to form the at least one hinge member.

4. The movable partition of claim 3, wherein the sheet of material comprises a thickness of between about one-half of a millimeter (0.5 mm) and about eight-tenths of a millimeter (0.8 mm).

5. The movable partition of claim 1, wherein the at least one hinge member and each of the panels of the sheet of panels is formed from the same material selected from the group consisting of a metal material, a polymer material, and a composite material.

6. The movable partition of claim 1, wherein one of the first lateral end and the second lateral end of the at least one hinge member is configured as a mirror image of a corresponding one of the first lateral end and the second lateral end of a panel of the sheet of panels, the mirror image being relative to a plane that extends coplanar with the first major surface of the at least one hinge member and a corresponding plane that extends coplanar with the first major surface of the corresponding panel of the sheet of panels when the movable partition is in a fully extended state.

7. The movable partition of claim 1, further comprising at least one retention clip attached to a first panel, the at least one retention clip configured to prevent inadvertent disengagement of the at least one hinge from the first panel.

8. A movable partition, comprising:

a sheet of panels configured to extend toward an extended state and to fold in an accordion fashion toward a retracted state, at least one joint between adjacent panels of the sheet of panels including a hinge member between the adjacent panels;

wherein each of the panels of the sheet of panels and the hinge member comprises:

a top edge;

a bottom edge;

an enlarged first lateral edge;

an enlarged second lateral edge;

a first major surface;

an opposite, second major surface;

a first lateral end extending between the top edge and the bottom edge, the first lateral end comprising a first generally cylindrical structure, the first generally cylindrical structure comprising a first opening extending linearly between the top edge and the bottom edge, the first opening comprising a gap between the first lateral edge and the first major surface; and an opposite, second lateral end extending between the top edge and the bottom edge, the second lateral end comprising a second generally cylindrical structure, the second generally cylindrical structure comprising a second opening extending linearly between the top edge and the bottom edge, the second opening comprising a gap between the second lateral edge and one of the first major surface and the opposite, second major surface;

wherein a length of each panel of the sheet of panels between the first lateral end and the second lateral end thereof is greater than a length of the at least one hinge member between the first lateral end and the second lateral end thereof, and wherein each panel of the sheet of panels is connected to a hinge member at one of the first or second lateral end of the panel of the sheet of panels, and to another panel of the sheet of panels at the other of the first or second lateral end of the panel of the sheet of panels.

9. The movable partition of claim 8, wherein the first lateral end of each hinge member is engaged with the second lateral end of an adjacent panel, and the second lateral end of each hinge member is engaged with the first lateral end of another adjacent panel.

10. A method of forming a movable partition, comprising:

forming a plurality of panels and at least one hinge member to each comprise:

a top edge;

a bottom edge;

a first major surface;

an opposite, second major surface;

an enlarged first lateral edge;

an enlarged second lateral edge;

a first lateral end extending between the top edge and the bottom edge, the first lateral end comprising a first generally cylindrical structure, the first generally cylindrical structure comprising a first opening extending linearly between the top edge and the bottom edge, the first opening comprising a gap between the enlarged first lateral edge and the first major surface; and an opposite, second lateral end extending between the top edge and the bottom edge, the second lateral end comprising a second generally cylindrical structure, the second generally cylindrical structure comprising a second opening extending linearly between the top edge and the bottom edge, the second opening comprising a gap between the enlarged second lateral edge and one of the first major surface and the opposite, second major surface, wherein a length of each panel of the sheet of panels between the first lateral end and the second lateral end thereof is greater than a length of the at least one hinge member between the first lateral end and the second lateral end thereof;

engaging the first lateral end of at least one panel of the plurality of panels with the second lateral end of the at least one hinge member; and engaging the second lateral end of the at least one panel of the plurality of panels with a first lateral end of another panel of the plurality of panels.

11. The method of claim 10, wherein forming at least one hinge member comprises forming a plurality of hinge members.

12. The method of claim 11, further comprising:

interconnecting panels of the plurality of panels with a hinge member of the plurality of hinge members at every other joint between the plurality of panels; and interconnecting panels of the plurality of panels directly to one another without using a hinge member at remaining joints between the plurality of panels.

13. The method of claim 10, further comprising configuring the plurality of panels and the at least one hinge member to extend to a fully extended state in which the plurality of panels and the at least one hinge member are at least substantially coplanar while the first lateral end of the at least one panel of the plurality of panels remains engaged with the second lateral end of at least another panel of the plurality of panels and while the second lateral end of the at least one panel of the plurality of panels remains engaged with the first lateral end of the at least one hinge member.

* * * * *